United States Patent [19]

Cowen et al.

[11] Patent Number: 4,752,547

[45] Date of Patent: Jun. 21, 1988

[54] DYE-FORMING ELECTROTHERMOGRAPHIC MATERIAL AND PROCESS

[75] Inventors: Stanley W. Cowen, Greece; James C. Fleming, Webster; Mark Lelental, Penfield, all of N.Y.

[73] Assignee: Eastman Kodak Company, Rochester, N.Y.

[21] Appl. No.: 870,572

[22] Filed: Jun. 4, 1986

[51] Int. Cl.[4] ..... G03G 15/24; G03G 13/22

[52] U.S. Cl. ..... 430/42; 430/45; 430/351; 430/353; 430/502; 430/618; 430/619

[58] Field of Search ..... 430/350, 42, 45, 351, 430/353, 502, 618, 619

[56] References Cited

U.S. PATENT DOCUMENTS

| | | | |
|---|---|---|---|
| 4,131,463 | 12/1978 | Tsubol et al. | 430/31 |
| 4,201,591 | 5/1980 | Reithel | 430/619 |
| 4,234,670 | 11/1980 | Kaukeinen et al. | 430/52 |
| 4,284,704 | 8/1981 | Fleming et al. | 430/154 |
| 4,294,912 | 10/1981 | Adin et al. | 430/341 |
| 4,343,880 | 8/1982 | Lelental | 430/42 |

FOREIGN PATENT DOCUMENTS

| | | |
|---|---|---|
| 12855 | 7/1980 | European Pat. Off. . |
| 8001322 | 6/1980 | PCT Int'l Appl. . |

OTHER PUBLICATIONS

Research Disclosure, Dec. 1978, Item No. 17643.
Research Disclosure, Jul. 1986, Item No. 14719.

*Primary Examiner*—John L. Goodrow
*Attorney, Agent, or Firm*—Richard E. Knapp

[57] ABSTRACT

A dye-forming electrothermographic element comprises an electrically activatable recording layer comprising (a) a reducing agent or reducing agent precursor capable of being activated by a Lewis base; (b) a cobalt-(III) Lewis base complex; and (c) at least one of (i) a reducible dye-forming compound that has an oxidation state above that of the conjugate dye, (ii) a dye capable of changing its wavelength of absorption by reaction with a Lewis base, and (iii) a dye-forming coupler capable of reacting with the oxidized form of the reducing agent in (a) to form a dye. A negative or positive dye image is formed in such a dye-forming electrothermographic element by applying an electrical potential imagewise to the element of a magnitude and for a time sufficient to produce in the image areas a charge density sufficient to produce a latent image; and, then, heating the element to a temperature and for a time sufficient to form a dye image in the element. The dye-forming electrothermographic element can be a multicolor, multilayer electrothermographic element.

20 Claims, 4 Drawing Sheets

STEP 1

STEP 2

STEP 3

STEP 4

DYE-FORMING ELECTROTHERMOGRAPHIC MATERIAL AND PROCESS

BACKGROUND OF THE INVENTION

This invention relates to dye-forming electrothermographic materials and processes which enable formation of dye images without the need for silver compounds.

Electrographic recording materials and processes and electrically activatable recording materials and processes which involve production of a visible image in a charge-sensitive recording element are known. Examples of such recording materials and processes are described in, for example, U.S. Pat. Nos. 4,234,670 and 4,343,880. Such recording materials and processes involve imagewise exposure of a charge-sensitive recording element to electric current to form a developable image in the charge-sensitive recording element followed by processing, preferably thermal processing, to form a silver image or a silver image and a dye image. A problem with these electrically activatable recording materials has been that they have required the presence of silver image-forming compounds. They have not enabled dye images, especially multicolor dye images from electrothermographic elements without incorporated silver image-forming compounds.

While dye-forming electrothermographic materials are described in, for example, U.S. Pat. No. 4,343,880, such materials require silver image-forming compounds.

A continuing need has existed for a dye-forming electrothermographic element and process which enable formation of a dye image, particularly a multicolor image, and which (a) avoid the need for silver image-forming compounds in imaging, (b) enable roomlight handling of the recording materials, and (c) avoid the need for conventional processing solutions and baths.

SUMMARY OF THE INVENTION

It has been found that the described advantages are provided by a dye-forming electrothermographic element comprising an electrically conductive support bearing an electrically activatable recording layer comprising:

(a) a reducing agent or reducing precursor capable of being activated by a Lewis base;
(b) a cobalt(III) Lewis base complex; and
(c) at least one of
  (i) a reducible dye-forming compound that has an oxidation state above that of the conjugate dye,
  (ii) a dye capable of changing its wavelength of absorption by reaction with a Lewis base, and
  (iii) a dye-forming coupler capable of oxidative coupling with the oxidized form of the reducing agent.

A negative or positive dye image is formed in such a dye-forming electrothermographic element by applying an electrical potential imagewise to the element of a magnitude and for a time sufficient to produce in the image areas a charge density sufficient to produce a latent image; then heating the element to a temperature and for a time sufficient to form a dye image in the element. The dye-forming electrothermographic element is preferably a multicolor, multilayer electrothermographic element.

Reducing agents or reducing agent precursors in the dye-forming electrothermographic element are capable of being activated by a Lewis base, particularly a Lewis base from the cobalt(III) Lewis base complex. Upon activation they serve to reduce additional Co(III) Lewis base complex which in turn releases more Lewis base. Additionally the reducing agent or reducing agent precursor may perform other functions in the electrothermographic element upon electrical exposure and thermal processing depending upon the composition of component (c). First, if component (c) is a reducible dye-forming compound that has an oxidation state above that of the conjugate dye, the reducing agent or the reducing agent formed from the reducing agent precursor causes the reducible dye-forming compound to be reduced enabling formation of a dye image. An example of this reaction is as follows:

(Reducing Agent) +

$$\text{(Reducible Dye-forming Compound)} \xrightarrow[\text{Base}]{\text{Lewis}} \text{(Dye Product)}$$

Second, if the component (c) is a dye capable of changing its wavelength of absorption the function of the reducing agent is to reduce the Co(III) complex with subsequent release of the Lewis base. Third, if component (c) is a coupler, then the reducing agent in oxidized form reacts with the coupler to form a dye.

The cobalt(III) Lewis base complex in the dye-forming electrothermographic element has the functions of enabling formation of a latent image upon electrical exposure of the dye-forming electrothermographic element and enabling release of a Lewis base upon thermal processing of the element.

A dye image can be produced by a thermal electrically activated recording process comprising the steps of (I) applying an electric potential imagewise to an electrically activatable recording layer of the dye-forming electrothermographic element of a magnitude and for a time sufficient to produce in the image areas a charge density sufficient to form a developable latent image in the recording layer; and, then (II) heating the element substantially uniformly at a temperature and for a time sufficient to produce a dye image in the recording layer. In this process embodiment, the electrically activatable recording layer comprises the described components; however, any means can be useful to produce the desired charge density in the recording layer, such as contact or non-contact electrodes.

A further process which has been found according to the invention which produces a dye image comprises (I) imagewise altering the conductivity of a photoconductive layer in accord with an image to be recorded; (II) applying across the photoconductive layer and the recording layer of a dye-forming electrothermographic element, as defined, an electrical potential of a magnitude and for a time sufficient to produce a developable latent image in the recording layer corresponding to the image to be recorded; and then (III) heating the recording layer substantially uniformly at a temperature and for a time sufficient to produce a dye image in the recording layer. The step (I) of imagewise altering the conductivity of the photoconductive layer is preferably carried out while simultaneously (II) applying the described electrical potential across the photoconductive layer and recording layer.

The heating step in each of the described process embodiments is carried out at a temperature which enables release of the Lewis base from the cobalt(III)

Lewis base complex and formation of the desired dye image, such as within the range of about 80° C. to about 200° C., typically at a temperature within the range of about 100° C. to about 180° C., until the desired dye image is formed.

The exact mechanism by which the latent image is formed in the recording material is not fully understood. It is postulated that the injection of a charge carrier due to the electric field into the combination of components in the dye-forming electrothermographic element results in the formation of a developable latent image in the electrically activated recording layer. It is believed that the development of the latent image is accomplished by a reaction in which the latent image helps initiate the reaction of the described image-forming combination.

While a variety of image recording combinations containing the described components can be useful, the optimum image recording combination and image recording element will depend upon such factors as the desired image, the particular image-forming combination, the source of exposing energy, processing condition ranges and the like.

The term "electrothermographic" herein refers to a material which, when subjected to an electrical current or subjected to an electrical potential field, undergoes a chemical and/or electrical change which provides a developable latent image that is developable by thermal processing.

The term "latent image" herein means an image that is not visible to the unaided eye or is faintly visible to the unaided eye and that is capable of amplification in a subsequent heat development step.

The term "electrically conductive," such as in "electrically conductive support," herein refers to a support or layer that has a resistivity less than about $10^{12}$ ohm-cm.

Figure 1A:
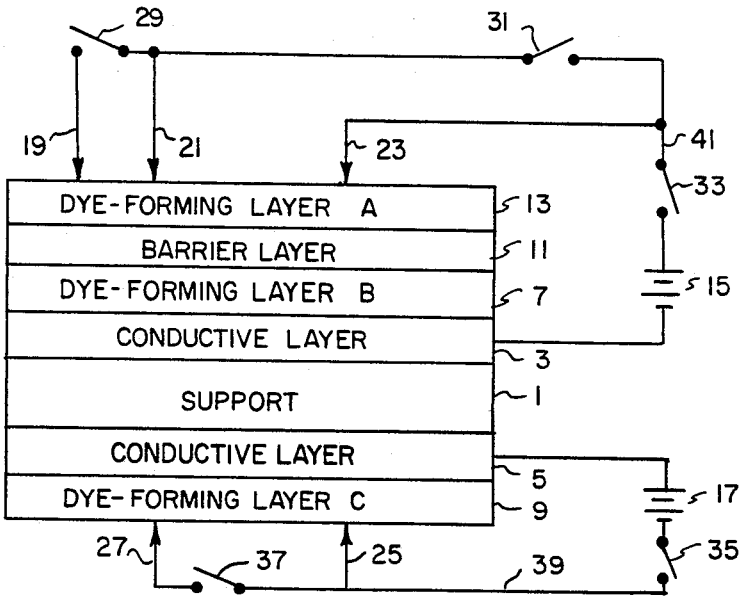
FIGS. 1A, 1B, 1C and 1D schematically illustrate a dye-forming electrothermographic material and process according to one illustrative embodiment of the invention.

Any dye-forming compound in (c) (i) is useful if it is reducible by the reducing agent in the presence of the Lewis base released from component (b). Useful reducible dye-forming compounds include, for example, tetrazolium or triazolium compounds which on reduction form formazan dyes, respectively. A wide variety of such tetrazolium salts are known in the imaging art including bistetrazolium salts linked directly or through intervening divalent radicals in the 2 or 5 positions. Exemplary known tetrazolium salts are listed in Tables I, II and III. Additional exemplary tetrazolium salts are disclosed in Tables III, V and VI of U.S. Pat. No. 4,284,704, the disclosure of which patent is incorporated herein by reference.

TABLE I

| | Exemplary Dye-forming Tetrazolium Salts |
|---|---|
| T-1 | 2,3,5-triphenyl-2H—tetrazolium tetrafluoroborate |
| T-2 | 2-(2-bromophenyl)-3,5-diphenyl-2H—tetrazolium tetrafluoroborate |
| T-3 | 2-(2-trifluoromethylphenyl)-3,5-diphenyl-2H—tetrazolium tetrafluoroborate |
| T-4 | 2-(4-cyanophenyl)-3,5-diphenyl-2H—tetrazolium tetrafluoroborate |
| T-5 | 2-(3-nitrophenyl)-3,5-diphenyl-2H—tetrazolium tetrafluoroborate |
| T-6 | 2-(2,6-dimethylphenyl)-3,5-diphenyl-2H—tetrazolium tetrafluoroborate |
| T-7 | 2-(2,4-dichlorophenyl)-3,5-diphenyl-2H—tetrazolium tetrafluoroborate |
| T-8 | 2,3-di(2-chlorophenyl)-5-phenyl-2H—tetrazolium tetrafluoroborate |
| T-9 | 2-(4-nitrophenyl)-3-(4-methoxyphenyl)-5-phenyl-2H—tetrazolium tetrafluoroborate |
| T-10 | 2-(4-nitrophenyl)-3-phenyl-5-(3,4-dimethoxyphenyl)-2H—tetrazolium tetrafluoroborate |
| T-11 | 2-(2-methoxyphenyl)-3-phenyl-5-(4-nitrophenyl)-2H—tetrazolium tetrafluoroborate |
| T-12 | 2-(2-methyl-4-nitrophenyl)-3,5-diphenyl-2H—tetrazolium tetrafluoroborate |
| T-13 | 2-(2-chloro-4-nitrophenyl)-3,5-diphenyl-2H—tetrazolium tetrafluoroborate |
| T-14 | 2-(4-nitrophenyl)-3-(2,6-dimethylphenyl)-5-phenyl-2H—tetrazolium tetrafluoroborate |
| T-15 | 2-(4-nitrophenyl)-3-(4-iodophenyl)-5-phenyl-2H—tetrazolium hexafluorophosphate |
| T-16 | 2-(4-cyanophenyl)-3-(2,5-dichlorophenyl)-5-(4-methoxyphenyl)-2H—tetrazolium tetrafluoroborate |
| T-17 | 2,3-diphenyl-5-n-hexyl-2H—tetrazolium tetrafluoroborate |
| T-18 | 2,3-diphenyl-2H—tetrazolium tetrafluoroborate |
| T-19 | 2-(2-chloro-4-nitrophenyl)-3-phenyl-5-methyl-2H—tetrazolium tetrafluoroborate |
| T-20 | 2,3-diphenyl-5-(3,4-dimethoxyphenyl)-2H—tetrazolium tetrafluoroborate |
| T-21 | 2-(2-phenoxy-5-chlorophenyl)-3,5-diphenyl-2H—tetrazolium tetrafluoroborate |
| T-22 | 2-(2-methoxyphenyl)-3-phenyl-5-n-hexyl-2H—tetrazolium tetrafluoroborate |
| T-23 | 2-(4-nitrophenyl)-3-(2,4-dichlorophenyl)-5-(4-methoxyphenyl)-2H—tetrazolium tetrafluoroborate |
| T-24 | 2-(2-bromo-4-nitrophenyl)-3,5-diphenyl-2H—tetrazolium hexafluoroborate |
| T-25 | 2-(2-bromo-4-nitrophenyl)-3-phenyl-5-methyl-2H—tetrazolium tetrafluoroborate |
| T-26 | 2-(2-methyl-4-nitrophenyl)-3-phenyl-5-methyl-2H—tetrazolium tetrafluoroborate |
| T-27 | 2-(2-pyridyl)-3,5-di(4-chlorophenyl)-2H—tetrazolium hexafluorophosphate |

Other examples of such dye-forming tetrazolium salts are described in U.S. Pat. No. 4,284,704.

Useful tetrazolium salts also include any desired combination of 2, 3 and, optionally, 5 position aromatic or aromatic-like heterocyclic rings, such as phenyl, naphthyl, anthryl, quinolinyl, pyridyl, azolyl and the like. Azolyl rings include oxazolyl, thiazolyl, benzoxazolyl, benzothiazolyl and the like. These rings are optionally substituted. Examples of specific useful ring substituents are alkyl, such as alkyl containing 1 to 6 carbon atoms; alkenyl, such as alkenyl containing 2 to 6 carbon atoms; alkynyl, such as alkynyl containing 2 to 6 carbon atoms; benzyl; styryl; phenyl; biphenylyl; naphthyl; alkoxy, such as methoxy and ethoxy; aryloxy, such as phenoxy; carboalkoxy, such as carbomethoxy and carboethoxy; carboaryloxy, such as carbophenoxy and carbonaphthoxy; acyloxy, such as acetoxy and benzoyloxy; acyl, such as acetyl and benzoyl; halogen, including fluoride, chloride, bromide and iodide; cyanide; azide; nitro; haloalkyl, such as trifluoromethyl and trifluoroethyl; amido, such as acetamido and benzamido; ammonia, such as trimethylammonia; azo, such as phenylazo; sulfonyl, such as methylsulfonyl; sulfonium, such as dimethyl sulfonium; silyl, such as trimethylsilyl and thioether, such as methylthio substituents.

Examples of useful tetrazolium salts having predominantly electronegative tetrazole nucleus substituents which provide useful dye stability are set forth in Table II.

TABLE II

| | |
|---|---|
| T-43 | 2-(2-chlorophenyl)-3-phenyl-5-(3-nitrophenyl)-2H—tetrazolium tetrafluoroborate |
| T-44 | 2-(4-nitrophenyl)-3-(4-iodophenyl)-5-phenyl-2H—tetrazolium tetrafluoroborate |
| T-45 | 2-(4-nitrophenyl)-3-(3,6-dichlorophenyl)-5-phenyl-2H—tetrazolium tetrafluoroborate |
| T-46 | 2-(4-nitrophenyl)-3-(2,4,6-trichlorophenyl)-5-phenyl-2H—tetrazolium tetrafluoroborate |
| T-47 | 2-(2-nitrophenyl)-3-(2-bromophenyl)-5-phenyl-2H—tetrazolium tetrafluoroborate |
| T-48 | 2-(2-nitrophenyl)-3-phenyl-5-(4-chlorophenyl)-2H—tetrazolium tetrafluoroborate |
| T-49 | 2-(4-nitrophenyl)-3-phenyl-5-(4-chlorophenyl)-2H—tetrazolium tetrafluoroborate |
| T-50 | 2-(2,4-dichlorophenyl)-3-phenyl-5-(3-nitrophenyl)-2H—tetrazolium tetrafluoroborate |
| T-51 | 2-(2,4,5-trichlorophenyl)-3-phenyl-5-(4-nitrophenyl)-2H—tetrazolium tetrafluoroborate |
| T-52 | 2,5-di(4-nitrophenyl)-3-phenyl-2H—tetrazolium tetrafluoroborate |
| T-53 | 2,5-di(4-nitrophenyl)-3-phenyl-2H—tetrazolium tetrafluoroborate |
| T-54 | 2,3-di(4-nitrophenyl)-5-phenyl-2H—tetrazolium hexafluorophosphate |
| T-55 | 2,3-di(2,5-dichlorophenyl)-5-(4-methoxyphenyl)-2H—tetrazolium tetrafluoroborate |
| T-56 | 2-(2-chloro-5-nitrophenyl)-3-(2,5-dichlorophenyl)-5-(4-methoxyphenyl)-2H—tetrazolium hexafluorophosphate |
| T-57 | 2-(4-nitrophenyl)-3-(4-chlorophenyl)-5-phenyl-2H—tetrazolium tetrafluoroborate |
| T-58 | 2-(4-methylthiophenyl)-3-(3,5-dichlorophenyl)-5-(3-nitrophenyl)-2H—tetrazolium hexafluorophosphate |
| T-59 | 2-(4-bromo-1-naphthyl)-3-(4-cyanophenyl)-5-(3,4-dichlorophenyl)-2H—tetrazolium chloride |
| T-60 | 2-(2-trifluoromethyl-5-chlorophenyl)-3-(4-cyanophenyl)-5-phenyl-2H—tetrazolium bromide |
| T-61 | 2-(2-chloro-5-nitrophenyl)-3-(4-acetylphenyl)-5-(3-nitrophenyl)-2H—tetrazolium chloride |
| T-62 | 2-[4-(4-nitrophenylthio)phenyl]-3-(2-chloro-5-fluoromethylphenyl)-5-(3-nitrophenyl)-2H—tetrazolium bromide |
| T-63 | 2-(4-phenylsulfonylphenyl)-3-(2-chloro-4-cyanophenyl)-5-(3,4-dichlorophenyl)-2H—tetrazolium chloride |

Any anion known to be useful in formazan dye-forming tetrazolium salts can be used in the described tetrazolium compounds. Preferred anions are those set forth in Tables I and II. Any one of these anions can be incorporated in place of any other anion in any of the tetrazolium salts set forth in Tables I and II. Nonbasic, nonnucleophilic anions are preferred, such as tetrafluoroborate and hexafluorophosphate, for example. Such anions provide the resulting tetrazolium salt with enhanced protection against anion induced reduction, and for this reason their use is preferred. Such anions also provide protection against the premature activation of (a), the reducing agent or reducing agent precursor.

It is known that formazan dyes may be chelated with various metal salts, such as those of iron, nickel, cobalt, copper, zinc, cadmium, chromium, titanium, molybdenum or tungsten. Such chelation can be useful to vary the color of the formazan dye or to stabilize it against fading.

It is believed that as the cobalt(III) complex as described is reduced to cobalt(II), releasing its Lewis base ligands. The cobalt(II) salt may chelate with the formazan dye to form a more stable dye image. Additional metal salts may be incorporated in the imaging element to chelate with and stabilize the formazan dye. All formazan dyes are capable of forming at least bidentate chelates. While distinct stabilization is observed for bidentate and tridentate formazan dye chelates, the use of tetrazolium salts that form tridentate chelates gives greater stabilization. Exemplary of tetrazolium salts capable of forming tridentate formazan dye chelates are those having one or more N-heterocyclic aromatic rings in the 2 or 3 position, such as 2-pyridyl, 2-quinolinyl and 2-azolyl, such as 2-thiazolyl, 2-benzotriazolyl, 2-oxazolyl and 2-benzoxazolyl ring structures. Examples of tetrazolium salts for forming highly stable tridentate formazan dye chelates are set forth in Table III.

TABLE III

Exemplary Tetrazolium Salts for Forming Tridentate Formazan Dye Chelates

| | |
|---|---|
| T-73 | 2-(2-pyridyl)-3-(2,6-dimethylphenyl)-5-phenyl-1-2H—tetrazolium hexafluorophosphate |
| T-74 | 2-(2-pyridyl)-3,5-diphenyl-2H—tetrazolium bromide |
| T-75 | 2-(2-pyridyl)-3-(4-chlorophenyl)-5-phenyl-2H—tetrazolium nitrate |
| T-76 | 2,3-di(benzothiazol-2-yl)-5-dodecyl-2H—tetrazolium chloride |
| T-77 | 2,3-di(benzothiazol-2-yl)-5-cyano-2H—tetrazolium chloride |

In addition to greater stability, another advantage of chelated formazan dyes is that they are generally more absorptive in the red spectrum than the corresponding unchelated formazan dyes. Thus, whereas formazan dyes generally tend toward red images, chelated formazan dyes are considerably bluer, producing darker images.

The formazan dye images produced can, if desired, be stabilized either by adding electronegative substituents to the tetrazole nucleus or by incorporating metal salts in combination with the tetrazolium salts. If desired, these two stabilization techniques can be used in combination. For example, some tetrazolium salts are sufficiently electronegative in their tetrazole nucleus substituents to constitute particularly useful tetrazolium salts in terms of stability, even without chelation. These tetrazolium salts can be useful to produce formazan dyes of even greater stability by forming tridentate chelates.

Triazolium salts are also useful as reducible dye-forming compounds in the present invention.

Particularly useful triazolium salts are those having an aromatic ring fused with the triazole nucleus. Although many triazolium salts are useful, such triazolium salts produce azoamine dyes of increased density as compared to triazolium salts lacking a fused aromatic ring. Further, these latter triazolium salts typically produce azoamino dyes of a yellow hue, whereas triazolium salts containing an aromatic ring fused with the triazole nucleus are typically either shifted toward the red portion of the spectrum or more neutral in hue.

Examples of useful ring substituents and the triazolium salts they form are set forth in the above-referenced U.S. Pat. No. 4,284,704 and in following Table IV. To enhance the stability of the azoamine dyes produced, it is preferred to incorporate predominantly electronegative substituents in the triazolium salts.

Any anion known to be useful in azoamine dye-forming triazolium salts is useful. Any one of these anions can be incorporated in place of any other anion in any of the triazolium salts set forth in Table IV. Nonbasic, non-nucleophilic anions are preferred, such as tetrafluoroborate and hexafluorophosphate, for example. Such anions provide the resulting triazolium salt with enhanced protection against anion induced reduction, and for this reason their use is preferred. Such anions also provide protection against the premature activation of (a), the reducing agent or reducing agent precursor.

Like the hereinbefore described formazan dyes, azoamine dyes formed by reduction of triazolium salts may be stabilized and have their colors influenced by chelating with metal salts. These dyes may be chelatable with the reduced cobalt complex to increase their stability. Metal salts as described in relation to formazan dye chelates may be used to provide chelation of the azoamine dyes. All azoamine dyes are capable of forming at least bidentate chelates. While distinct stabilization can be achieved with bidentate and tridentate chelates, the use of triazolium salts that form tridentate chelates gives greater stabilization. Exemplary triazolium salts capable of forming tridentate azoamine dye chelates are those having one or more N-heterocyclic aromatic rings in the 1 or 2 position, such as 2-pyridyl and 2-azolyl, such as 2-triazolyl, 2-benzothiazolyl, 2-oxazolyl and 2-benzoxazolyl ring structures.

Examples of particularly preferred triazolium salts useful in the practice of this invention are set forth below in Table IV.

TABLE IV

| Triazolium Salts for Forming Azoamine Dyes | |
|---|---|
| Tr-1 | 1-methyl-2-phenyl-2H—1,2,3-triazolium tetrafluoroborate |
| Tr-2 | 1-neopentyl-2-phenyl-2H—1,2,3-triazolium iodide |
| Tr-3 | 1-(n-butyl)-2-phenyl-6-nitro-2H—benzo-1,2,3-triazolium iodide |
| Tr-4 | 2-phenyl-3-(pyrid-2-yl)-2H—naphtho-[1,2-d]-1,2,3-triazolium perchlorate |
| Tr-5 | 2-(4-carbomethoxyphenyl)-3-phenyl-2H—naphtho-[1,2-d]-1,2,3-triazolium hexafluorophosphate |
| Tr-6 | 2-(4-cyano-1-naphthyl)-3-phenyl-2H—naphtho-[1,2-d]-1,2,3-triazolium tetrafluoroborate |
| Tr-7 | 2-(1-nitro-2-naphthyl)-3-phenyl-2H—naphtho-[1,2-d]-1,2,3-triazolium tetrafluoroborate |
| Tr-8 | 2,3-diphenyl-5-phenoxy-2H—naphtho[1,2-d]-1,2,3-triazolium nitrate |
| Tr-9 | 2,2'-(p-phenylene)bis(3-phenyl-2H—naphtho-[1,2-d]-1,2,3-triazolium hexafluorophosphate) |
| Tr-10 | 2,2'-(2-chloro-1,4-phenylene)bis(3-phenyl-2H—naphtho[1,2-d]-1,2,3-triazolium hexafluorophosphate) |
| Tr-11 | 2,2'-(1,5-naphthylene)bis(3-phenyl-2H—naphtho[1,2-d]-1,2,3-triazolium hexafluorophosphate) |
| Tr-12 | 2,3-di(4-methoxyphenyl)-5-nitro-2H—naphtho-[1,2-d]-1,2,3-triazolium bromide |

The reducible dye-forming compound (c) (i) is useful in a dye-forming electrothermographic element in any concentration that enables the desired dye-forming reaction upon thermal processing. The recording layer generally contains the reducible dye-forming compound (c) (i) or combination of such compounds within the range of 0.1 to 10 mole of dye-forming compound (c) (i) per mole of Co(III) complex in the recording layer. Selection of an optimum concentration of reducible dye-forming compound (c) (i) will depend upon such factors as the particular components of the dye-forming electrothermographic element, the desired image, processing conditions, and the particular reducible dye-forming compound (c) (i).

Any dye that is capable of changing its wavelength of absorption of reaction with a Lewis base is useful as component (c) (ii) in a dye-forming electrothermographic element as described. The component (c) (ii) can be a dey that changes its wavelength of absorption from a first wavelength prior to electrical exposure of the element to any second wavelength of absorption after electrical exposure and thermal processing of the dye-forming electrothermographic element. Examples of such useful component (c) (ii) are 2,4-diphenyl-6-(6-methyl-3,4-di-ethoxystyryl)pyrrylium tetrafluoroborate and 1,1-diethyl isocyanine iodide.

The dye (c) (ii) that is capable of changing its wavelength of absorption by reaction with a Lewis base is useful in a dye-forming electrothermographic element in any concentration that enables the desired dye-forming reaction upon thermal processing. The recording layer generally contains the dye (c) (ii) or a combination of such dyes within the range of 0.1 to 10 mole of dye (c) (ii) per mole of Co(III) complex in the recording layer. Selection of an optimum concentration of dye (c) (ii) will depend upon such factors as the particular components of the dye-forming electrothermographic element, the desired image, processing conditions, and the particular dye (c) (ii).

Any dye-forming coupler is useful in the element and process as described as component (c) (iii) provided it forms a dye upon oxidative coupling with the reducing agent or reducing agent formed from the reducing agent precursor in component (a) upon electrical exposure and thermal processing of the dye-forming electrothermographic element. The dye-forming coupler herein means a compound or combination of compounds which, with other of the described components, upon oxidative coupling produces a desired dye image upon heating the recording layer after electrical exposure. These are designated as dye-forming couplers because it is believed that the compounds couple with the oxidized reducing agent to produce the desired dye. The dye-forming couplers described herein are also known in the photographic art as color-forming couplers. Combinations of dye-forming couplers are useful. Selection of an optimum dye-forming coupler or coupler combination will be influenced by such factors as the desired dye image, other components of the recording layer, processing conditions, particular reducing agent in the recording layer and the like. An example of a useful magenta dye-forming coupler is 1-(2,4,6-trichlorophenyl)-3-{3-[α-(3-pentadecylphenoxy)-butyramido]benzamido}-5-pyrazolone. A useful cyan dye-forming coupler is 2,4-dichloro-1-naphthol. A useful yellow dye-forming coupler is α-{3-[α-(2,4-di-tertiaryamylphenoxy)acetamido]benzoyl}-2-fluoroacetanilide. Useful cyan, magenta and yellow dye-forming couplers are selected from those known in the photographic art such as described in, for example, "Neblette's Handbook of Photography and Reprography", edited by John M. Sturge, Seventh Edition, 1977, pages 120 and 121, and *Research Disclosure*, Vol. 176, December 1978, Item 17643, paragraphs VII C-G.

Other examples of useful dye-forming couplers are as follows:

Couplers which form cyan dyes upon reaction with the oxidized form of a described reducing agent, especially a color developing agent, are described in each representative patents and publications as U.S. Pat. Nos. 2,772,162; 2,895,826; 3,002,836; 3,034,892; 2,474,293; 2,423,730; 2,367,531; 3,041,236; and 4,248,962. Preferably such couplers are phenols and naphthols which form cyan dyes on reaction with oxidized color developing agent in the presence of a Lewis base in the dye-forming electrically activatable exposed recording element upon processing. Structures of examples of such couplers are:

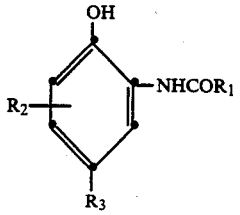

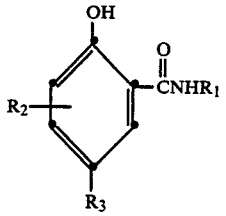

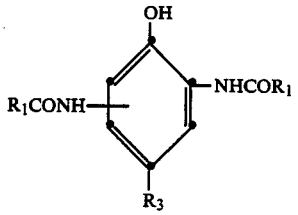

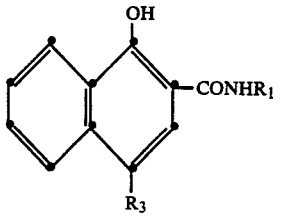

wherein:

$R_1$ represents a ballast group;

$R_2$ represents one or more halogen, such as chlorine or fluorine; alkyl, such as alkyl containing 1 to 4 carbon atoms, for example methyl, ethyl, propyl and butyl; or alkoxy, such as alkoxy containing 1 to 4 carbon atoms, for example methoxy, ethoxy, propoxy and butoxy; and, $R_3$ is hydrogen or a coupling-off group, that is a group capable of being released upon reaction of the oxidized form of the reducing agent with the coupler.

Couplers which form magenta dyes upon reaction with the oxidized form of a described reducing agent, especially a color developing agent, are described in such representative patents as U.S. Pat. Nos. 2,600,788; 2,369,489; 2,343,703; 2,311,082; 3,152,896; 3,519,429; 3,062,653; 2,908,573; and 4,248,962. Preferably such couplers are pyrazolones, pyrazolotriazoles and pyrazoloimidazoles which form magenta dyes upon reaction with the oxidized form of the described reducing agent, especially a color developing agent. Structures of examples of magenta dye-forming couplers are:

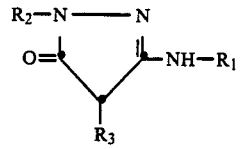

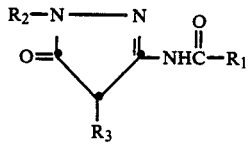

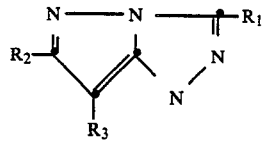

wherein:

$R_1$ and $R_3$ are as defined above; and $R_2$ is as defined above or is phenyl or substituted phenyl, such as 2,4,6-trichlorophenyl.

Couplers which form yellow dyes upon reaction with the oxidized form of a described reducing agent, especially a color developing agent, are described in such representative patents as U.S. Pat. Nos. 2,875,057; 2,407,210; 3,265,506; 2,298,443; 3,048,194; 3,447,928; and 4,248,962. Preferably such yellow dye-forming couplers are acylacetamides, such as benzoylacetanilides and pivalylacetanilides. Structures of examples of such yellow dye-forming couplers are:

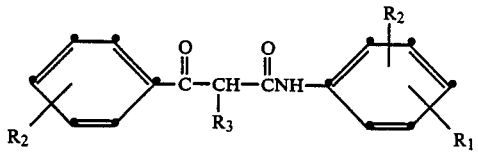

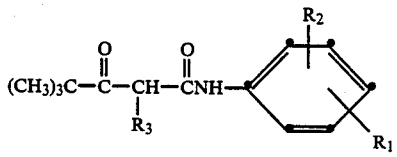

wherein:

$R_1$ and $R_3$ are as defined above;

$R_2$ is hydrogen; one or more halogen, such as chlorine or bromine; alkyl, such as alkyl containing 1 to 4 carbon atoms, for example methyl, ethyl, propyl or butyl; or a ballast group, such as an alkoxy group containing 16 to 20 carbon atoms or an alkyl group containing 12 to 30 carbon atoms.

Couplers which form black dyes upon reaction with the oxidized form of a described reducing agent, especially a color developing agent, are described in such representative patents as U.S. Pat. Nos. 1,939,231; 2,181,944; 2,333,106; 4,126,461; 4,429,035; and 4,200,466. Preferably such black dye-forming couplers are resorcinolic couplers or m-aminophenol couplers.

Structures of examples of such black dye-forming couplers are:

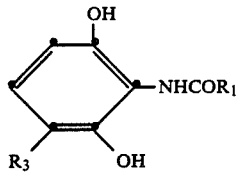

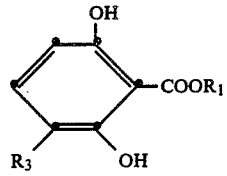

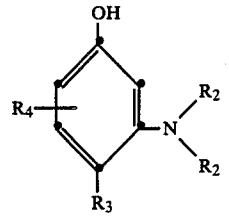

wherein:

$R_1$ is alkyl containing 3 to 20 carbon atoms, phenyl, or phenyl substituted with hydroxy, halo, amino, alkyl of 1 to 20 carbon atoms, or alkoxy of 1 to 20 carbon atoms;

each $R_2$ is independently hydrogen, halogen, alkyl, such as alkyl of 1 to 20 carbon atoms, alkenyl, such as alkenyl of 1 to 20 carbon atoms, or aryl, such as aryl of 6 to 20 carbon atoms;

$R_3$ is hydrogen or a coupling-off group;

$R_4$ is one or more halogen, alkyl, such as alkyl of 1 to 20 carbon atoms, alkoxy, such as alkoxy of 1 to 20 carbon atoms, or other monovalent organic groups that do not adversely affect coupling activity of the described couplers.

An example of a specific coupler that is particularly useful is 2-acetamidoresorcinol.

When the dye-forming electrothermographic element comprises a coupler, the coupler can comprise a timing group (TIME) which is displaced from the coupler as a result of reaction of the coupler with the oxidized form of the reducing agent, particularly the oxidized form of a color developing agent, and thereafter undergo a reaction, such as an intramolecular nucleophilic displacement reaction, to release a useful group (RUG). The coupler can comprise a timing group between the coupler moiety and the useful group, so that the reaction of the coupler with the oxidized form of the reducing agent, especially the oxidized form of a color developing agent, cleaves the bond between the timing group and the coupler and then cleaves the bond between the useful group and the timing group.

Couplers which comprise a timing group and a releasable useful group are represented by the structure:

COUP-TIME-RUG wherein:

COUP is a coupler moiety;

TIME is a timing group; and

RUG is a releasable useful group.

The COUP can be any coupler moiety that will react with the oxidized form of the reducing agent, especially the oxidized form of a color developing agent, to release TIME-RUG. The COUP includes coupler moieties known to be useful in the photographic art. The TIME group also can be any timing group which is capable of being released upon reaction of COUP with the oxidized form of the reducing agent. The TIME group can be any of those TIME groups known to be useful with couplers in the photographic art, such as described in U.S. Pat. Nos. 4,248,962 and 4,409,323. The releasable useful group (RUG) can be any useful group which can be released during processing of the dye-forming electrically activatable recording element and which aids in providing a useful dye image.

Herein the terms "coupler" and "coupler compound" refer to the entire compound, including the coupler moiety, any timing group and any useful group bonded directly or indirectly to the coupler moiety. The term "coupler moiety" herein refers to that portion of the coupler other than a timing group, if any, and other useful group.

In the case of a coupler, the coupler moiety can be unballasted or ballasted in order to maintain its location in the dye-forming electrothermographic element. The coupler can be a monomeric, oligomeric or polymeric coupler or combinations of such couplers.

The product formed upon thermal processing of the dye-forming electrothermographic element can be: (1) colored and nondiffusible; (2) colored and diffusible; or (3) colorless and diffusible or nondiffusible, in which case it will not contribute to image density. In cases (2) and (3) the reaction product may be initially colored and/or nondiffusible but converted to colorless and/or diffusible products during processing. In case (3) the reaction product may also be converted to colored and diffusible or nondiffusible by reaction with another component in the dye-forming electrothermographic element or in a contiguous image receiver optionally present.

The RUG can be any group that is desirably made available in a dye-forming electrothermographic element, preferably in an imagewise fashion. The RUG can be a dye or a reagent which upon release further reacts with components in the element, such as a development inhibitor, a development accelerator, a coupler, such as a competing coupler, a dye-forming coupler, a DIR coupler, a developing agent, such as a competing developing agent, a toner, a hardener, a tanning agent, a fogging agent, an antifoggant, a chemical or spectral sensitizer and a desensitizer.

The RUG can be present in the coupler as a preformed species or it can be present in a blocked form or as a precursor. For example, a preformed development inhibitor may be attached to a timing group or the development inhibiting function may be blocked by being the point of attachment to a timing group. As another example, a preformed dye may be attached to a timing group, a dye which is blocked so as to shift its spectral absorption may be attached to a timing group or a leuco dye may be attached to a timing group.

The couplers which release a dye or dye precursor can be used in processes where the dye is allowed to diffuse to an integral or separate receiving layer to form a desired image. Alternatively, the dye can be retained in the location where it is released to augment the density of the dye formed from the coupler from which it is released or to modify or correct the hue of that dye or another dye. In another embodiment, the dye can be completely removed from the element and the dye which was not released from the coupler can be retained in the element as a color correcting mask.

The dye-forming coupler or coupler combination is useful in a range of concentrations of the described recording layer. The recording layer generally contains a concentration of dye-forming coupler that is within the range of about 0.1 to about 10 mole of the dye-forming coupler per mole of (a), the reducing agent or reducing agent precursor in the recording layer. An especially useful concentration of dye-forming coupler is within the range of about 0.5 to about 2.0 mole of dye-forming coupler per mole of (a) in the recording layer.

Selection of an optimum concentration of dye-forming coupler will depend upon such factors as the particular coupler, the desired image, processing conditions, and other components in the recording layer.

Any cobalt(III) Lewis base complex is useful as component (b). The component (b) upon electrical exposure enables or aids in formation of a latent image in the dye-forming electrothermographic element, and upon thermal processing of the exposed dye-forming electrothermographic element releases a Lewis base. The terms Lewis acid and Lewis base are employed in the same context as described for these terms in conventional organic chemistry text books such as C. R. Noller, "The Chemistry of Organic Compounds" 2nd Ed., W. B. Saunders Company, Phila. and London (1958) p. 236.

Such cobalt(III) complex image forming materials are known in the imaging art and are described in, for example, *Research Disclosure,* Vol. 168, Item No. 16845; *Research Disclosure,* Vol. 126, Item No. 12617; *Research Disclosure,* Vol. 185, Item No. 18535; *Research Disclosure,* Vol. 158, Item No. 15874; *Research Disclosure,* Vol. 184, Item No. 18436; U.S. Pat. No. 4,273,860; U.K. published Application No. 2,012,445A; European Pat. No. 12,855; and published application WO No. 80/01322, the disclosures of which are incorporated herein by reference.

Preferred cobalt(III) complexes feature a molecule having a cobalt atom or ion surrounded by a group of atoms, ions or other molecules which are generically referred to as ligands. The cobalt atom or ion in the center of these complexes is a Lewis acid while the ligands are Lewis bases. Trivalent cobalt complexes, that is cobalt(III) complexes, are useful because the ligands are relatively tenaciously held in these complexes and released when the cobalt is reduced to the (II) state.

While silver salts are not necessary or desirable in an electrothermographic element as described, many organic silver salt oxidizing agents are useful in the described image-forming combination in the recording layer. The organic silver salt oxidizing agent is typically resistant to darkening upon illumination, which helps reduce undesired deterioration of the developed image. One class of silver salt oxidizing agents is represented by the silver salts of long-chain fatty acids which are stable to light. The term "long-chain", as used herein, is intended to mean a chain of carbon atoms containing 10 to 30 carbon atoms. Compounds within this class which are useful include silver behenate, silver stearate, silver oleate, silver laurate, silver hydroxystearate, silver caprate, silver myristate and silver palmitate.

Any reducing agent or reducing agent precursor is useful as component (a) that is capable of being activated by a Lewis base and enables the Co(III) complex to be reduced and the desired dye image to be formed. Selection of an optimum reducing agent will depend upon the particular components of the dye-forming electrothermographic element, particularly components (b) and (c), as well as the processing conditions.

Any reducing agents or reducing agent precursors which, in their oxidized form, form a dye with the described dye-forming coupler are useful in the recording element according to the invention. The reducing agent is typically an organic silver halide color developing agent. Combinations of reducing agents are useful. When (c) is a coupler, it is important that the reducing agent produces an oxidized form which can react at processing temperature with the described dye-forming coupler to produce a desired dye. Especially useful reducing agents are primary aromatic amines. Examples of useful reducing agents which are primary aromatic amines include p-aminophenol;
2,6-dichloro-p-aminophenol;
4-amino-N,N-dimethylaniline;
4-amino-N,N-diethylaniline;
4-amino-3-methyl-N,N-diethylaniline (also known as N,N-diethyl-3-methyl-paraphenylenediamine);
4-amino-N-ethyl-N-β-hydroxyethylaniline;
4-amino-3-methyl-N-ethyl-N-β-hydroxyethylaniline;
4-amino-3-methoxy-N-ethyl-N-β-hydroxyethylaniline;
4-amino-N-butyl-N-gamma-sulfobutylaniline;
4-amino-3-methyl-N-ethyl-N-β-sulfoethylaniline;
4-amino-3-β-(methanesulfonamido)ethyl-N,N-diethylaniline;
4-amino-3-β-(methanesulfonamido)ethylaniline;
4-amino-3-methyl-N-ethyl-N-β-methoxyethylaniline and the like. Salts of these amines are also useful such as hydrochlorides or hydrotetrafluoroborates.

Other examples of useful reducing agents or reducing agent precursors are sulfonylhydrazones.

The described reducing agent is useful in a range of concentrations on the described element according to the invention. Selection of an optimum concentration of reducing agent or combination of reducing agents will depend upon the described factors including the desired image, the particular dye-forming coupler, processing conditions and the like. A useful concentration of reducing agent or combination of reducing agents is within the range of about 0.1 to about 10 moles of reducing agent per mole of Co(III) complex in the recording layer as described. An especially useful concentration of reducing agent is within the range of about 0.2 to about 2 moles of reducing agent per mole of Co(III) complex in the recording layer.

The described element according to the invention need not, but typically does, comprise a separate binder. The described element typically comprises a variety of colloids and polymers alone or in combination as vehicles and binding agents. These vehicles and binding agents are in various layers of the element, especially in the recording layers. Useful materials are hydrophobic or hydrophilic. It is necessary, however, that the vehicle or binder in the element not adversely affect the charge sensitivity or ohmic resistivity of the element of the invention. Accordingly, the selection of an optimum colloid or polymer, or combination of colloids or polymers, depends upon such factors as the desired charge sensitivity, desired ohmic resistivity, particular polymer, particular components in the layer, desired image and particular processing conditions. Useful colloids and polymers are transparent or translucent and include both naturally occurring substances, such as proteins, for example, gelatin, gelatin derivatives, cellulose derivatives, polysaccharides, such as dextran, gum arabic and the like. Synthetic polymers, however, are preferred, due to their desired charge sensitivity properties and ohmic resistivity properties. Useful polymeric materials for this purpose include polyvinyl compounds, such as poly(vinyl pyrrolidone), acrylamide polymers and dispersed vinyl compounds, such as in latex form. Effective polymers include water insoluble polymers of alkyl acrylates and methacrylates, acrylic acid, sulfoalkyl acrylates, methacrylates and those which have cross-linking sites which facilitate hardening or curing. Especially useful polymers are high molecular weight materials and resins which are compatible with the described components of the element according to the invention. These include, for example, poly(vinyl butyral), cellulose acetate butyrate, poly(methyl methacrylate), poly(vinylpyrrolidone), ethyl cellulose, polystyrene, poly(vinyl chloride), poly(isobutylene), butadiene-styrene copolymers, vinyl chloride-vinyl acetate copolymers, copolymers of vinyl acetate, vinyl chloride and maleic acid and poly(vinyl alcohol). Combinations of colloids and polymers are also useful, depending upon the described factors. Highly preferred binders include cellulose esters such as cellulose acetate butyrate and acrylic esters such as poly(methyl methacrylate).

An illustrative group of useful polymeric binders in a dye-forming electrothermographic element as described is represented by the formula:

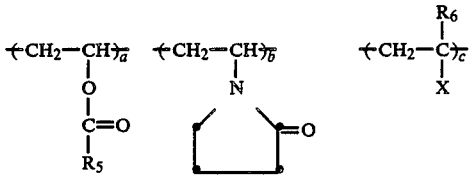

wherein $R_5$ is alkyl, such as alkyl containing 1 to 10 carbon atoms, for example methyl, ethyl, propyl, butyl, and decyl; aryl, such as aryl containing 6 to 10 carbon atoms, for example phenyl and naphthyl; or aralkyl, such as aralkyl containing 7 to 15 carbon atoms, for example benzyl and phenethyl;

$R_6$ is hydrogen or methyl;

a is 99 to 50 weight percent;

b is 50 to 1 weight percent;

c is 0 to 15 weight percent;

X is aryl, such as aryl containing 6 to 12 carbon atoms, for example phenyl, naphthyl and biphenylyl; or

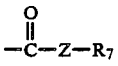

wherein Z is —O— or

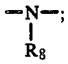

$R_7$ and $R_8$ are individually hydrogen, alkyl, preferably alkyl containing 1 to 10 carbon atoms, such as methyl, ethyl, propyl, octyl and decyl; or aryl, preferably aryl containing 6 to 16 carbon atoms, such as phenyl and naphthyl; provided that $R_7$ is hydrogen when Z is

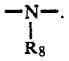

An especially useful polymeric binder within this group of binders is poly(vinyl acetate-co-vinyl benzoate-co-N-vinyl-2-pyrrolidone).

An overcoat layer is useful on the recording layer according to the invention. It is important that the overcoat layer not adversely affect the desired charge sensitivity and ohmic resistivity properties of the element according to the invention. Such an overcoat layer reduces fingerprinting and abrasion marks before and after exposure and processing. The overcoat layer is one or more of the described polymers which are useful as binders. These materials must be compatible with other components of the described element according to the invention and must be able to tolerate the processing temperatures which are useful for developing the described images.

Polymeric barrier layers are particularly useful in dye-forming electrothermographic elements and processes as described to separate the dye-image forming layers. Such barrier layers enable control or prevention of transfer of components between layers. For example, a polymeric barrier layer can control the degree of transfer and development that can occur between layers in a multilayer dye-forming electrothermographic element. The polymeric barrier layer can also provide prevention or control of intermixing of components during coating of the dye-forming layers in preparation of a dye-forming electrothermographic element. Any polymer is useful as a barrier layer provided that the polymer does not adversely affect the desired electrical and image-forming properties of the dye-forming electrothermographic element and is compatible with components, if any, in the barrier layer and in other layers of the element, particularly contiguous layers. Highly useful polymers as barrier layers are those polymers that function as amine scavengers, that is the polymers comprise groups capable of reacting with amines, such as propanediamine, released by the dye-forming layers upon processing of the exposed dye-forming electrothermographic element. Examples of useful polymers for barrier layer purposes are represented by the formula:

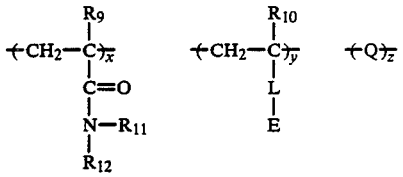

wherein:

$R_9$ and $R_{10}$ are individually hydrogen or methyl;

$R_{11}$ and $R_{12}$ are individually hydrogen or alkyl, such as alkyl containing 1 to 6 carbon atoms, for example methyl, ethyl, propyl, butyl and hexyl;

Q represents a recurring unit derived from a monomer having an appended sulfonic acid or sulfonate salt group, for example, sodium 3-acryloyloxypropanesulfonate, sodium 2-acrylamido-2-methylpropanesulfonate and other monomers described in U.S. Pat. Nos. 2,923,734; 3,024,221; 3,506,707; and *Research Disclosure,* Item No. 19551, July 1980. E is an amine-reactive group, such as an electrophilic group which reacts with an amine, for example a chloroacetyl, chloromethyl, chloroethylsulfonyl, chloroethylcarbonyl, vinyl sulfonyl, aldehyde or carboxy group. L is a linking group such as an ester (—COO—), amide (—CONH— or —NHCO—), alkylene, arylene or combinations of such linking groups, for example —$CONHC_6H_5CH_2$—, —$CONHCH_2NHCOCH_2CH_2$—, —$CONH(CH_2)_3NHCO$—, —$C_6H_4CH_2$— and —$CONH(CH_2)_2CONH$—. The x, y and z represent weight percent wherein x is 0 to 95 weight percent, y is 3 to 45 weight percent and z is 0 to 75 weight percent.

Examples of useful polymers for polymeric barrier layers are as follows:

Poly{acrylamide-co-N-[4-(2-chloroethylsulfonylmethyl)phenyl]acrylamide-co-sodium-2-acrylamido-2-methylpropanesulfonate} (weight ratio 75/20/5)

Poly{acrylamide-co-N-[3-(2-chloroethylsulfonylpropionylaminomethyl]acrylamide} (weight ratio 80/20)

Poly{acrylamide-co-N-[3-(chloroacetamido)propyl]-methacrylamide-co-sodium 2-acrylamido-2-methylpropanesulfonate} (weight ratio 75/20/5)

Poly{acrylamide-co-N-[3-(chloroethylsulfonyl)propionylaminomethyl]acrylamide-co-sodium 2-acrylamido-2-methylpropanesulfonate} (weight ratio 75/20/5)

Poly{sodium 2-acrylamido-2-methylpropanesulfonate-co-N-[3-(2-chloroethylsulfonyl)propionylaminoethyl]acrylamide} (mole ratio 3/1; weight ratio 68/32)

Poly{sodium 2-acrylamido-2-methylpropanesulfonate-co-N-[3-(chloroacetamido)propyl]methacrylamide} (mole ratio 3/1; weight ratio 73/27)

Poly{sodium 2-acrylamido-2-methylpropanesulfonate-co-N-[4-(2-chloroethylsulfonylmethyl)phenyl]acrylamide} (mole ratio 3/1; weight ratio 67/33)

Poly{acrylamide-co-N-[3-(chloroacetamido)propyl]-methacrylamide} (weight ratio 80/20)

Poly{acrylamide-co-N-[4-(2-chloroethylsulfonylmethyl)phenyl]acrylamide} (weight ratio 95/5)

Poly{acrylamide-co-N-[4-(2-chloroethylsulfonylmethyl)phenyl]acrylamide} (weight ratio 80/20)

Poly{acrylamide-co-m- & p-(2-chloroethylsulfonylmethyl)styrene-co-sodium 2-acrylamido-2-methylpropanesulfonate] (weight ratio 75/20/5)

Poly{acrylamide-co-N-[3-(2-chloroethylsulfonyl)-propionylaminomethyl]acrylamide} (weight ratio 80/20)

Poly[acrylamide-co-acrylic acid] (weight ratio 70/30)

A styrene-butadiene copolymer is not useful alone as a barrier layer because it does not have adequate barrier properties to control or prevent an undesired degree of transfer of components between layers.

The thickness of the barrier layer should be sufficient to enable the desired control or prevention of transfer of components between layers. Typically the barrier layer thickness is within the range of 0.1 to 2.0 microns.

In most cases, a photosensitive component is unnecessary and undesirable in an electrothermograhic element as described. The photosensitive component is any photosensitive metal salt or complex which produces developable nuclei upon charge exposure according to the invention. If a photosensitive component is present in the recording layer, a typical photosensitive metal salt is photosensitive silver halide. Examples of photosensitive silver halide are silver chloride, silver bromide, silver bromoiodide or mixtures thereof. For purposes of the invention, silver iodide is also considered to be a photosensitive silver halide. The photographic silver halide is prepared by any of the procedures known in the photographic art.

If a photosensitive component is present in the described electrically activated recording layer, the described image-forming combination enables the concentration of the photosensitive component to be lower than normally would be expected in a photosensitive element. This lower concentration is enabled by the amplification effect of the image-forming combination, as described, as well as the formation of developable nuclei according the invention. In some instances, the concentration of photosensitive metal salt is sufficiently low that, after imagewise exposure and development of the photosensitive metal salt alone, in the absence of other of the described imaging components, the developed image is not visible to the unaided eye.

Another illustrative combination of components useful as dye-forming electrothermographic materials comprises the combination of oxidizable dye-forming agents, such as 4-nitrocatechol, or a sulfonamidodiphenylamine, such as 4-n-hexyloxy-2'-pivalamido-4'-(2,4,6-triisopropylphenyl)-N-(sulfonamido)-N,N-diphenylamine or {methylenebis[4-hydroxy-3-(2,4,6-triisopropylphenyl)]sulfonamidobenzene, or a sulfonamidophenol, such as 2,6-dichloro-4-phenylsufonamidophenol, with a cobalt(III) amine complex in a polymeric binder. A dye-forming coupler as described can also be present in the combination of components. The use in such a combination of photoreductants or photoinhibiting agents, known in the cobalt imaging art, such as photooxidants and photolytic acid generators is not necessary and often is not desirable; however, if such components are present, the imaging combination can be a negative-working or positive-working photothermographic material.

The elements according to the invention, if desired, contain addenda which aid in producing a desired image. The addenda include, for example, development modifiers that function as speed-increasing compounds, hardeners, plasticizers and lubricants, coating aids, brighteners, sensitizing dyes, absorbing and filter dyes. These addenda are described in, for example, *Product Licensing Index,* December 1971, Publication No. 9232 and *Research Disclosure,* Vol. 176, December 1978, Item 17643.

The element according to the invention comprises an electrically conductive support. The term "electrically conductive support" herein includes (a) supports that are electrically conductive without the need for separate addenda in the support or on the support to produce the desired degree of electrical conductivity, and (b) supports that comprise addenda or separate electrically conductive layers that enable the desired degree of electrical conductivity. Useful supports include electrically conductive cellulose ester, poly(vinyl acetal), poly(ethylene terephthalate), polycarbonate and polyester film supports and related films and resinous materials. Other supports are useful, such as glass, paper, metal and the like which can withstand the processing temperatures described and do not adversely affect the charge-sensitive properties and ohmic resistivity which is desired. A flexible support is most useful. It is necessary that the various layers according to the invention adhere to the support. Such a subbing layer is, for example, a poly(methylacrylate-co-vinylidene chloride-coitaconic acid) subbing layer.

The components of the dye-forming electrically activatable recording element, including the reducing agent or reducing agent precursor, the cobalt(III) Lewis base complex, the reducible dye-forming compound, the dye capable of changing its wavelength of absorption, and the dye-forming coupler can be in any location in the dye-forming electrically activatable recording element which enables the desired dye-forming reaction upon exposure and processing. The components can, for example, be in a single layer or in multilayer format. The components can be in one layer or in contiguous or adjacent layers provided they come into reactive association upon processing to enable formation of a dye image. The dye-forming electrically activatable recording layer or layers of the element can contain or have associated therewith, other addenda which aid in imaging such as colored masking compounds, including colored masking couplers.

Preferred cobalt(III) complexes are those having a coordination number of six. A wide variety of ligands are useful to form a cobalt(III) complex. The preferred cobalt(III) complex is one which aids in generating an amine. Cobalt(III) complexes which rely upon chelation of cobalt(II) to form added dye density are also useful in materials according to the invention. Useful amine ligands in cobalt(III) complexes according to the invention include, for example, methylamine, ethylamine, ethylenediamine, propane diamine, ammines, and amino acids such as glycinato. The term "ammine" refers to ammonia, when functioning as a ligand, whereas "amine" indicates the broader class noted above. The diamine and ammine complexes are highly useful in producing dye images.

The cobalt(III) complexes useful according to the invention include neutral compounds which are entirely free of either anions or cations. The cobalt(III) complexes also include one or more cation and anions as determined by the charge neutralization rule. Herein the terms "anion" and "cation" refer to non-ligand anions and non-ligand cations unless otherwise indicated. Useful cations are those which produce readily soluble cobalt(III) complexes, such as alkyl metal and quaternary ammonium cations.

A wide variety of anions are useful, such as those listed in *Research Disclosure,* Vol. 184, Item No. 18436. The choice of an optimum anion depends in part on whether or not added compounds are present that are sensitive to, or reactive with, the anion.

Exemplary cobalt(III) complexes are those set forth in Table V. Further exemplary cobalt(III) complexes are described in Table I of U.S. Pat. No. 4,334,005, the disclosure of which is incorporated herein by reference.

TABLE V

| Exemplary Cobalt(III) Complexes | |
|---|---|
| C-1 | hexammine cobalt(III) trifluoroacetate |
| C-2 | chloropenta-ammine cobalt(III) bromide |
| C-3 | bis(ethylenediamine) di-ammine cobalt(III) perchlorate |
| C-4 | bis(methylamine) tetra ammine cobalt(III) hexafluorophosphate |
| C-5 | trinitrotris ammine cobalt(III) |
| C-6 | tris(1,3-propanediamine) cobalt(III) |

TABLE V-continued

| Exemplary Cobalt(III) Complexes | |
|---|---|
| | trifluoroacetate |
| C-7 | bis(dimethylglyoxime) ethylaquo cobalt(III) |
| C-8 | penta-ammine carbonato cobalt(III) nitrate |
| C-9 | trans[bis(ethylenediammine) diazido cobalt(III)] chloride |
| C-10 | bis(ethylenediamine) dithiocyanato cobalt(III) fluoride |
| C-11 | triethylenetetramine dinitro cobalt(III) (1,3-propanediamine) nitrate |
| C-12 | tris(trimethylenediamine) cobalt(III) trifluoromethanesulfonate |

Certain cobalt(III) complexes are themselves amine responsive and can release their Lewis base ligands upon exposure to an amine. These complexes preferably contain an ammonia cleavable bond, such as a dichalcogenide bond. Such complexes have the added advantage of functioning both as image amplifiers and as base-releasing complexes capable of reduction in the presence of a reducing agent.

Useful reducing agent precursors that upon exposure to a Lewis base form a reducing agent, provided the reducing agent is capable of reducing the reducible dye precursor and the Lewis base ligand releasing cobalt(III) complex, include quinones; phthalaldehyde; thioamides such as thiourea, thioacetamide, and thiosemicarbazides such as 1,4-diphenyl-3-thiosemicarbazide. Lewis bases as described above, such as ammonia and primary or secondary amines, can undergo reductive addition with such reducing agent precursors to form the corresponding reducing agent.

Examples of useful Lewis bases include ammonia, amines, hydroxy ion, carboxylates, mercaptides, thiocyanate, alkyl or aryl sulfinate, cyanide or sulfite.

For purposes of this invention, a reducing agent precursor is any compound that upon exposure to a Lewis base forms a reducing agent. The reducing agent, whether included in the composition originally or formed from a reducing agent precursor, undergoes an increase in reducing activity upon exposure to such bases.

Quinones are examples of useful reducing agent precursors. Preferred quinones are those which are unsubstituted in at least one quinoid ring position adjacent a carbonyl group, such as a 2 or 3 ring position in the case of 1,4-benzoquinones and 1,4-naphthoquinones. Also, at least one of the substituents on the quinoid ring is electronegative, such as keto, carboxylic acid, carboxylate, carboxylic acid amide, carboxylic acid ester, alkoxy, sulfonic acid ester, sulfonic acid amide, cyano, nitro, halo, or aryl. Exemplary quinones useful in the practice of the invention include 2-acetyl-5-methyl-1,4-benzoquinone
2-phenyl-1,4-benzoquinone
2-phenylsulfonyl-1,4-benzoquinone
2-methoxy-1,4-benzoquinone
2-phenyl-1,4-naphthoquinone
2-acetyl-1,4-naphthoquinone
2-n-butoxycarbonyl-1,4-benzoquinone
2-phenylsulfonamido-1,4-benzoquinone
2-t-butyl-1,4-benzoquinone
2-phenylsulfonyl-5,6-dimethyl-1,4-benzoquinone Particularly useful reducing agents when component (c) is a tetrazolium or triazolium salt are those that upon exposure to a Lewis base are capable of being ionized, the Lewis base being capable of reductive addition to the oxidized form of the reducing agent, or upon heating undergo an increase in reducing activity, provided that after such an increase, the reducing agent is capable of reducing the dye-forming compound and the Lewis base ligand releasing cobalt(III) complex. The activity of the reducing agent must be low enough to be stable toward the reducible dye-forming compound and the cobalt(III) complex, but high enough to respond to the base exposure on heating and initiate the reaction sequence. During the reaction sequence, the Lewis base ligands released by the cobalt(III) complex increase the activity of the reducing agent and may undergo reductive addition with the oxidized reducing agent.

Hydroquinones are particularly useful as reducing agents when component (c) is a tetrazolium or triazolium salt.

Examples of useful hydroquinones include 2-acetyl-5-methylhydroquinone
2-phenylsulfonylhydroquinone
2-n-butylsulfonylhydroquinone
2-α-benzylsulfonylhydroquinone
2-methylsulfonylhydroquinone
2-methylsulfonyl-3,5-dichlorohydroquinone
2,6-dichlorohydroquinone
2-sulfonylphenyl-5,6-dimethylhydroquinone
2-β-naphthylsulfonylhydroquinone
2-carboxy-1,4-hydroquinone The stability of the electrically activatable recording layers of electrically activatable recording elements capable of forming dye images according to the invention comprising the cobalt(III) Lewis base complex depend, in part, on the selection of an anion for the complexes. The order of preference of anion will vary with the particular cobalt(III) Lewis base, the particular coupler, developing agent, and other components of the dye-forming electrically activatable recording element. For tris(trimethylenediamine) cobalt(III) complexes the order of anion preference based on storage stability during storage is (1) $CF_3SO_3^{\theta}$, (2) $C_3F_7CO_2^{\theta}$, (3) $CF_3CO_2^{\theta}$, (4) $BF_4^{\theta}$.

At least one of the imaging layers of the dye-forming electrothermographic element can optionally comprise a hydrazone reducing agent, such as a sulfonylhydrazone reducing agent, with a cobalt(III) amine complex and a dye-forming coupler. The imaging layer can also comprise an acid, such as p-toulenesulfonic acid, to aid in imaging. Examples of useful hydrazone reducing agents are:

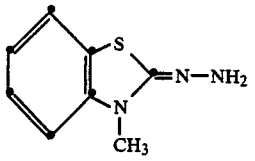

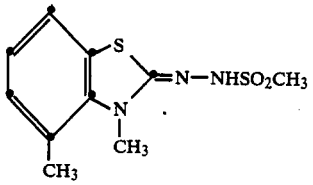

-continued

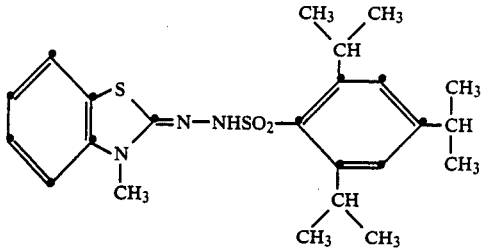

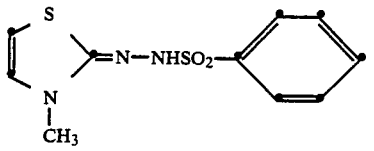

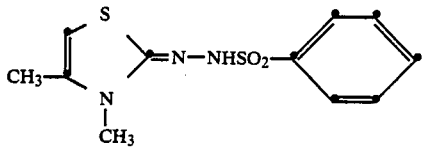

Any dye-forming couplers or combination of dye-forming couplers known in the photographic art are useful with the hydrazone reducing agents. Dye-forming couplers or combinations of dye-forming couplers that form yellow dyes with sulfonylhydrazone reducing agents are particularly useful.

Another illustrative dye-forming electrothermographic material comprises the combination of (a) a sulfonylhydrazone reducing agent, especially a Lewis base activated sulfonylhydrazone reducing agent, which in oxidized form is capable of oxidative coupling, (b) cobalt(III) amine complexes, (c) optionally an incorporated acid, such as p-toluenesulfonic acid or benzoic acid, and (d) a dye-forming coupler which is capable of reacting with the oxidized form of the reducing agent to form a dye. The combination is preferably in a polymeric binder which enables the desired dye-forming reaction upon exposure and processing. The combination of components also provides a useful thermographic imaging material. While not typically desirable, the incorporation of a photoreductant or photoinhibitor known in the photothermographic materials art in the element also enables the imaging element to be a photothermographic imaging material.

The described layers according to the invention are coated by coating procedures known n the photographic art, including dip coating, airknife coating, curtain coating or extrusion coating using hoppers known in the photographic art. If desired, two or more layers are coated simultaneously.

The various components of the charge-sensitive materials according to the invention are prepared for coating by mixing the components with solutions or mixtures, including organic solvents, depending upon the particular charge-sensitive material and the components. The components are mixed and added by means of procedures known in the photographic art.

In one embodiment the cobalt(III) coordination complex, reducing agent or reducing agent precursor, dye-forming coupler, and an organic acid or inorganic acid are dissolved in a polymeric binder solution and coated as at least one of the dye-forming layers.

Useful charge-sensitive elements according to the invention comprise an electrically conductive support having thereon an electrically activatable recording layer which has a thickness within the range of about 1 to about 30 microns, typically within the range of 2 to 15 microns. The optimum layer thickness of each of the layers of an element according to the invention depends upon such factors as the particular ohmic resistivity desired, charge sensitivity, particular components of the layers and the desired image.

A "melt-forming compound" is useful in the recording layer according to the invention to produce an improved developed image. The term "melt-forming compound" herein means a compound which, upon heating to the described processing temperature, produces an improved reaction medium, typically a molten medium, wherein the described image-forming combination can produce a desired image upon development. The exact nature of the reaction medium at the processing temperature described is not fully understood. It is believed that at the reaction temperature, as described, a melt occurs which permits the reaction components to better interact. If desired, a melt-forming compound is included with other components of the recording layer prior to coating on the described support. Examples of useful melt-forming compounds include succinimide, dimethyl urea, sulfamide and acetamide.

Optionally, an organic or inorganic acid is added to the dye-forming layer to aid imaging. For example, p-toluenesulfonic acid and/or benzoic acid can help promote improved image dye formation.

Referring to the drawings, embodiments of the invention are schematically illustrated in FIGS. 1A, 1B, 1C and 1D. According to the embodiments in FIGS. 1A, 1B, 1C and 1D, a dye-forming electrothermographic element comprises a support, such as a poly(ethylene terephthalate) film, typically having thereon a subbing layer, not shown, such as a poly(methyl acrylate-co-vinylidene chloride-co-itaconic acid) layer not shown, on each side. On the support 1 are electrically conductive layers 3 and 5, such as cermet layers. The combination of 1, 3 and 5 provide an electrically conductive support, typically a transparent electrically conductive support. The electrically conductive layers 3 and 5 can have a polymer layer thereon, not shown, which can increase the sensitivity of the dye-forming electrothermographic element, such as an electrically active conductive layer (EAC layer) as described in, for example, U.S. Pat. No. 4,343,880. Such an electrically active conductive layer (EAC layer) can be, for example a poly(alkyl acrylate-co-vinylidene chloride-co-itaconic acid) layer. Useful polymers for the subbing layers, not shown, and/or the EAC layer, also not shown, are described in, for example, U.S. Pat. No. 3,271,345.

In the embodiment of FIG. 1A dye-forming electrothermographic layer 7 designated as layer B and dye-forming layer 9 designated as layer C are on the conducting layers 3 and 5. An optional barrier layer 11 separates dye-forming electrothermographic layer 13 designated as layer A from dye-forming electrothermographic layer 7. Dye-forming electrothermographic layers 13, 7 and 9 can form dye images of the same hue or different hues. For example, layer 13 can comprise a dye-forming electrothermographic layer which is capable of forming a cyan, magenta or yellow dye image, typically a cyan dye image; layer 7 can comprise a dye-forming electrothermographic layer which is capable of forming a cyan, magenta or yellow dye image, typically a magenta dye image; and layer 9 can comprise a dye-forming electrothermographic layer which is capable of forming a cyan, magenta, yellow or black dye image, typically a yellow dye image. Layers 13, 11, 7 and 9 can be single layers or be multiple layer units, not shown in FIG. 1. Prior to imagewise electrical exposure of the dye-forming electrothermographic element illustrated in FIG. 1A electrical power sources 15 and 17 are not connected to electrical contacts 19, 21, 23, 25 and 27 because switches 29, 31, 33, 35 and 37 are in the open position so that electrical current will not pass through the connecting means 39 and 41 to the electrical contacts. While only five electrical contacts 19, 21, 23, 25 and 27 are illustrated, it will be understood that this is representative of the multiple contacts, such as are present on an electrical printing contact head, that can be useful in image-wise exposing the dye-forming electrothermographic element. The electrical connecting means 39 and 41 can also comprise electrical controls, not shown, which enable control of the amount, time and duration of electrical current to the various electrical contacts.

Figure 1B:
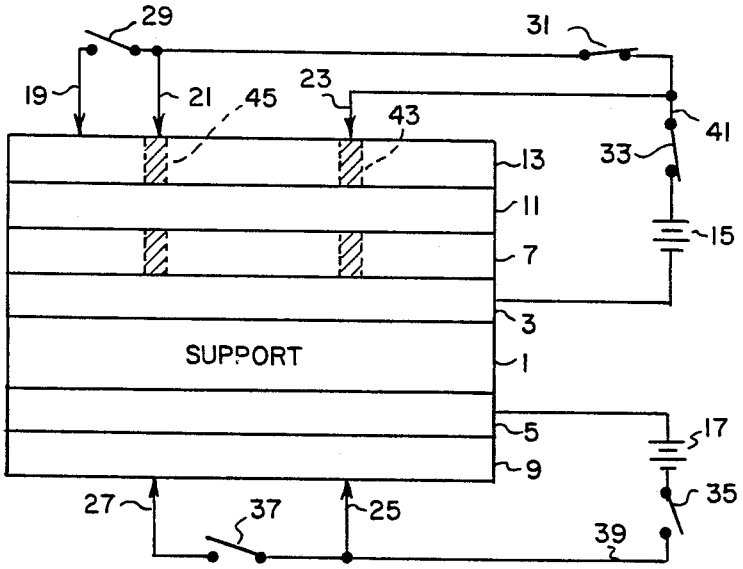

During imagewise electrical exposure as illustrated in Step 2 in FIG. 1B, electrical switches 31 and 33 are in a closed condition enabling electrical current to pass through electrical contacts 21 and 23 forming latent images 43, 45, 47 and 49 in layers 13 and 7. The polarity of current can be positive or negative.

Figure 1C:
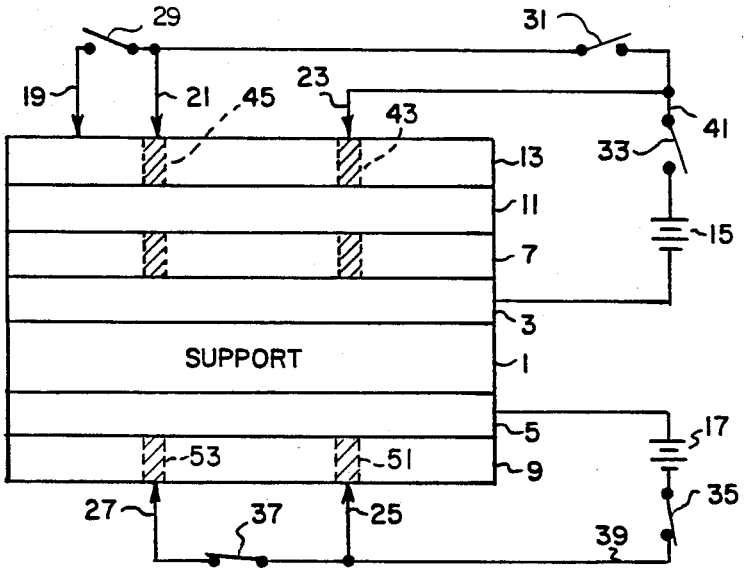

After Step 2, or optionally during Step 2, latent images 51 and 53 illustrated in FIG. 1C are formed in layer 9 by having switches 35 and 37 in a closed condition enabling current to pass to contacts 25 and 27.

Although a particular technique to produce an imagewise current flow through the image recording layers is illustrated, techniques and means for producing an imagewise current flow known in the art of recording are useful and intended to be included in the description. The areas 43, 45, 47, 49, 51 and 53 of the recording layers are intended to be illustrative of areas of latent image sites formed upon imagewise current flow through the recording layers. Other techniques and means for producing an imagewise current flow are also useful, such as a photoconductor means, an electrostatically charged stencil or scanning the dye-forming electrothermographic element with a beam of electrons.

Figure 1D:
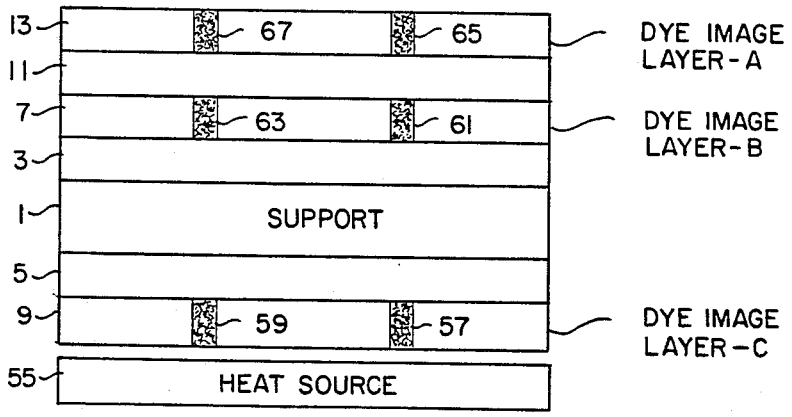

FIG. 1D illustrates development of the latent images formed in the dye-forming electrothermographic element illustrated in FIGS. 1B and 1C by, for example moving the element from step 3, illustrated in FIG. 1C, in step 4, illustrated in FIG. 1D, into contact with a heating means 55, such as a heated metal platen. The heat from the heating means 55 passes through the dye-forming electrothermographic element to cause the desired image dye-forming reaction in the image areas. The reaction in the image areas causes formation of dye images 57, 59, 61, 63, 65 and 67. If desired, the dye-forming electrothermographic element can be heated from both sides of the element. For example, the dye images 57 and 59 can be yellow dye images; dye images 61 and 63 can be magenta dye images; and, dye images 65 and 67 can be cyan dye images. The dye images can, but need not be, in register with each other, to form a multicolor image. The dye images can form an image for subtractive color or additive color viewing depending on the components of the various layers and colors of the dyes formed. No processing solutions or baths are required in the heat development step.

Figure 2:
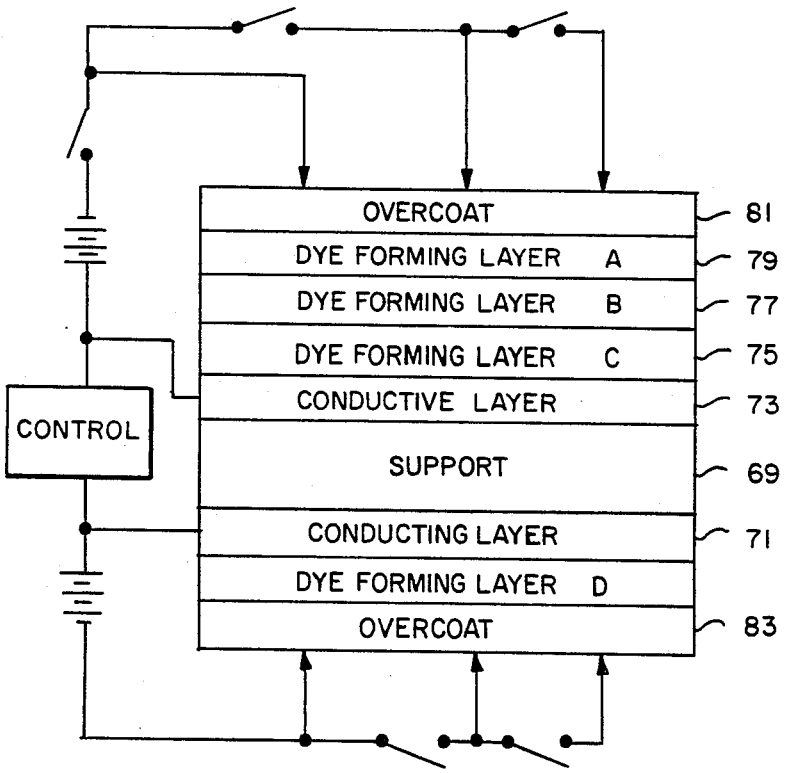
FIG. 2 schematically illustrates another dye-forming electrothermographic material according to another embodiment of the invention.

Another illustrative embodiment of the invention is schematically illustrated in FIG. 2. In the embodiment of FIG. 2 an electrically conductive support consists of support 69 having thereon electrically conducting layers 71 and 73. The electrically conductive support has, on one side, dye-forming layers 75, 77 and 79 which can be single layers or multiple layer units. The optional overcoat layers 81 and 83 provide protection of the element from, for example, scratches and marks. The optional overcoat layers 81 and 83 can comprise polymers such as poly(vinyl butyral) or poly(vinyl acetate), which do not adversely affect the desired properties of the dye-forming electrothermographic element.

Figure 3:
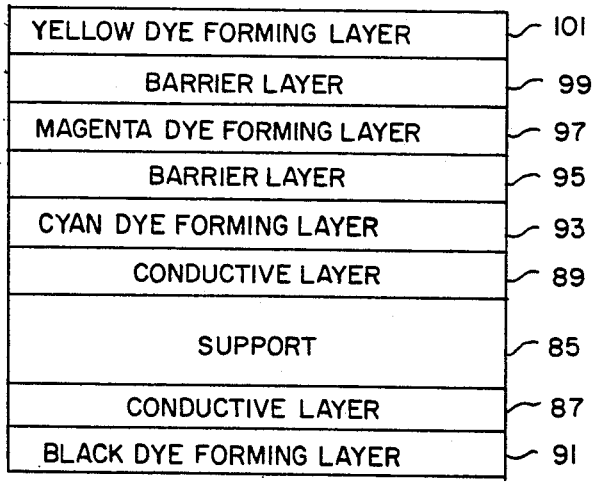
FIG. 3 schematically illustrates another dye-forming electrothermographic material according to a further embodiment of the invention.

Another illustrative embodiment of the invention is schematically illustrated in FIG. 3. In the embodiment of FIG. 3 an electrically conductive support comprises support 85 having thereon electrically conductive layers 87 and 89, typically cermet layers. On the electrically conductive support, on one side is dye-forming layer 91 capable of forming a black dye image. On the side of the electrically conductive support opposite the side containing layer 87 are electrothermographic layer 93 capable of forming a cyan dye image, barrier layer 95, electrothermographic layer 97 capable of forming a magenta dye image, barrier layer 99 and electrothermographic layer 101 capable of forming a yellow dye image.

Figure 4:
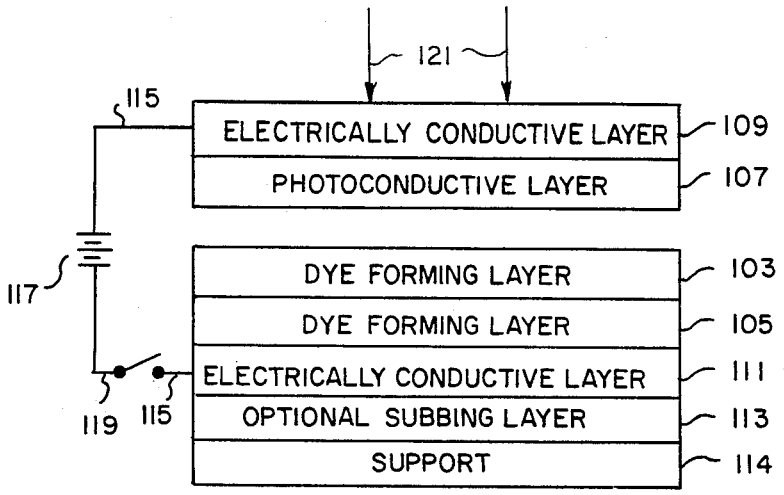
FIG. 4 schematically illustrates another dye-forming electrothermographic material according to a further embodiment of the invention comprising multiple dye-forming electrothermographic layers.

A further illustrative embodiment of the invention is schematically illustrated in FIG. 4. In this embodiment in FIG. 4, latent image sites, not shown, are formed by sandwiching current sensitive, dye-forming layers 103 and 105 and image-to-current converter layer, typically a photoconductor layer, between a pair of electrically conductive layers 109 and 111. The electrically conductive layer 109 can optionally be on a support, not shown. The electrically conductive layer 111, typically a cermet layer, is on an optional subbing layer 113 that is on support 114.

A high potential electric field is established across the photoconductor layer 107 and dye-forming layers 103 and 105 by connecting the conductive layers 109 and 111 by connecting means 115 containing power source 117. The electric field across the layers is controlled by switch 119. The latent image formation in latent image sites in layers 103 and 105 is caused by imagewise exposing the photoconductor layer 107 through the electrically conductive layer 109 to exposure means 121, typically visible light. The layer 109 must be sufficiently transparent to the exposure means 121 to enable the exposure to pass to a desired degree to photoconductor layer 107. The exposure selectively increases the conductivity of the layer 107 in those regions exposed to the exposure means. When switch 119 is closed, thereby establishing an electric field across the layers, an imagewise current flow is produced through the layers 103 and 105. The current flow is produced through the layers 103 and 105. The current flow occurs in those regions of layers 103 and 105 only in position with the exposed portions of the photoconductor layer 107. An air gap of up to 20 microns or an electrically conductive layer, not shown, such as described in U.S. Pat. No. 4,409,307, is present between layer 107 and layer 103. After a sufficient charge density, typically less than 10 microcoul/cm$^2$, has been produced in the current exposed portions of the layers 103 and 105, switch 119 is opened thereby disrupting the current flow. The described technique for application of voltage across the photoconductor layer 107 and layers 103 and 105 is illustrative. A variety of techniques known in the recording art are useful and are intended to be included in this description.

To form a visible dye image in an exposed dye-forming electrothermographic element, the element is moved away from the photoconductor layer. Connecting means 115 is also disconnected. The element is then heated, preferably substantially uniformly, at a temperature and for a time sufficient to enable formation of dye images in layers 103 and 105. A barrier layer, not shown, can be present to separate layer 103 from layer 105.

The photoconductor layer, such as layer 107 in FIG. 4, can contain any binder and/or sensitizer which enables desired exposure of layers 103 and 105. Useful binders are described in, for example, U.S. Pat. No. 2,361,019 and U.S. Pat. No. 2,258,423. Useful sensitizing compounds are described in, for example, U.S. Pat. No. 3,978,335.

If desired, the dye-forming electrothermographic element and imaging means are readily modified to provide a continuous image recording operation. This is carried out by means of desired control circuitry and continuous transport apparatus, not shown.

The desired resistivity characteristics of a recording material according to the invention is obtained by separately measuring the current-voltage characteristic of each sample coating at room temperature by means of a mercury contact sample holder to make a mercury contact to the surface of the coating. The resistivity is measured at various ambient temperatures. The data is measured at a voltage of, for example, 20 volts or $4\times10^4$ volts per centimeter, which is within the ohmic response range of the layer to be tested. It is expected that the resistivity of the charge-sensitive layer will vary widely with temperature. It is also expected that the dielectric strength of the layer will vary with temperature. The selection of an optimum temperature for exposure is determined based on the dielectric strength of the layer.

An imagewise current flow is produced through the described electrothermographic recording layer. Although a particular technique to produce an imagewise current flow has been described for use in a variety of recording apparatus, the especially useful techniques are those which include use of an array of contact electrodes an an image to current converter.

Many photoconductors are useful according to the invention to enable imagewise electrical exposure of the dye-forming electrothermographic element. Selection of an optimum photoconductor depends upon such factors as the particular electrically activated recording layer, the charge sensitivity of the element, the desired image, the ohmic resistivity desired, exposure means, processing conditions and the like. It is advantageous to select a photoconductor which has the property of being the most useful with the operative voltages to be used for imaging. The photoconductor is either an organic photoconductor or an inorganic photoconductor. Combinations of photoconductors are useful. The resistivity of the photoconductor can change rapidly in the operating voltage ranges which can be useful according to the invention. In some cases, it is desirable that the photoconductive layer have what is known in the art as persistent conductivity. Examples of useful photoconductors include lead oxide, cadmium sulfide, cadmium selenide, cadmium telluride and selenium. Useful organic photoconductors include, for instance, poly(vinyl carbazole)/trinitrofluorenone photoconductors and aggregate type organic photoconductors described in, for example, U.S. Pat. No. 3,615,414. These photoconductors are known in the image recording art and are described in, for example U.S. Pat. No. 3,577,272; *Research Disclosure,* Vol. 112, August 1973, Item 11210 of Reithel, published by Kenneth Mason Publications Limited; Emsworth; Hampshire P010 7DD; United Kingdom; "Electrography", by R. M. Schaffert (1975), and "Xerography and Related Processes," by Dessauer and Clark (1965), both published by Focal Press Limited, and U.S. Pat. No. 3,615,414.

Heating the recording element after latent image formation is carried out by techniques and means known in the photographic art. For example, the heating is carried out by passing the imagewise exposed recording element over a heated platen or drum or through heated rolls, by heating the element by means of microwaves, by means of dielectric heating or by means of heated air. A visible image is produced in the described exposed material within a short time, that is, typically within about 1 to about 90 seconds, by the described uniform heating step. For example, the recording element is uniformly heated to a temperature within the range of about 100° C. to about 200° C. until a desired image is developed, typically within about 1 to about 90 seconds. The imagewise exposed material according to the invention is preferably heated to a temperature within the range of about 110° C. to about 180° C. The optimum temperature and time for processing depends upon such factors as the desired image, the particular recording element and heating means.

Some of the dye-forming electrothermographic elements as described are also useful as thermographic recording elements or, when a photographic component is present, as photothermographic elements. For example, a thermographic element comprises a support bearing a dye-forming thermographic layer comprising (i) a reducing agent or reducing agent precursor capable of being activated by a Lewis base, (ii) a cobalt(III) Lewis base complex, and (iii) a reducible dye or dye-forming compound that has an oxidation state above that of the conjugate dye or a dye capable of changing its wavelength of absorption by reaction with a Lewis base to form a dye. The inclusion of a photoreductant or a photoinhibitor in the thermographic element also enables the element to be a photothermographic element. The imaging element accordingly can be useful for forming an image by (a) imagewise exposure to light followed by overall heating, (b) imagewise heating or (c) imagewise electrical exposure followed by overall heating.

Another illustrative example of a dye-forming material comprises, in a binder, (i) a reducing agent or reducing agent precursor which is a quinone or a hydroquinone compound which is capable of being activated by an amine; (ii) a cobalt(III) Lewis base complex which is, for example, a cobalt(III) amine complex; and (iii) a reducible dye-forming compound which is a tetrazolium and/or a triazolium compound. Such a dye-forming material can comprise one or more of the layers of a dye-forming electrothermographic element.

A further illustrative example of a useful dye-forming electrothermographic material comprises the combination of a sulfonamidophenol reducing agent, such as 2,6-dichloro-4-sulfonamidophenol or 2,6-dibromo-4-sulfonamidophenol, with a cobalt(III) amine complex, such as cobalt(III) hexammine trifluoroacetate, cobalt(III) tris(ethylenediamine) trifluoroacetate or cobalt(III) tris(trimethylenediamine) trifluoroacetate, and a dye-forming coupler, as described, in a binder, also as described, such as poly(ethylene-co-1,4-cyclohexylenedimethylene-1-methyl-2,4-benzenedisulfonamide).

The following examples further illustrate the invention.

EXAMPLE 1

This example illustrates a typical dye-forming electrothermographic element and process according to the invention.

A dye-forming electrothermographic element was prepared as follows:

The following composition was coated at 100 micron wet coating thickness on an electrically conductive support which was a poly(ethylene terephthalate) film having thereon a cermet layer and subbed with poly(methyl methacrylate-co-vinylidene chloride):

| | |
|---|---|
| cellulose acetate butyrate (binder) | 10 ml of 6.25% by weight solution in acetone |
| 2:1 acetone-methanol (solvent) | 1.5 ml |
| surfactant (SF-1066, which is a polysiloxane and a tradename of General Electric Co. U.S.A.) | 0.06 g |
| tris(trimethylenediamine) cobalt(III) trifluoroacetate monohydrate (cobalt(III) Lewis base complex) | 0.50 g |
| 2,6-dichlorobenzenesulfonamidophenol (reducing agent) | 0.051 g |
| 2,4-bis(trichloromethyl)-6-α-naphthyl-s-triazine (stabilizer) | 0.020 g |
| magenta dye-forming coupler which was: | 0.224 g |

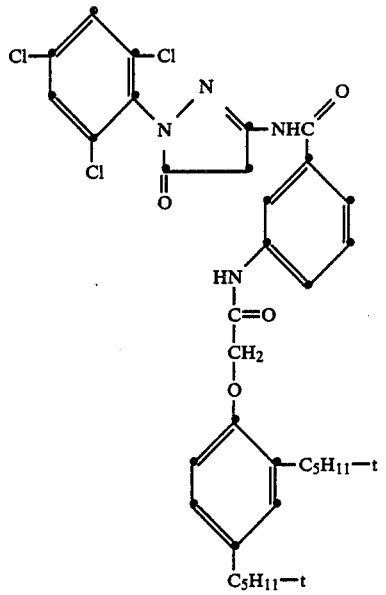

The resulting dye-forming electrothermographic element was imagewise electrically exposed by means of a mercury contact electrode at positive 150 volts varying the exposure from 14 to 0.6 milicoulombs/cm$^2$. The exposed dye-forming electrothermographic element was then heated for 10 seconds at 115° C. A dye image was formed having a green maximum transmission density of 0.67 with a minimum density of 0.13 at a charge exposure of 14 milicoulombs.

EXAMPLE 2

A dye-forming electrically activatable recording element was prepared as described in Example 1 with the exception that the coupler which formed magenta dye was replaced by 0.160 g of the following coupler capable of forming a cyan dye:

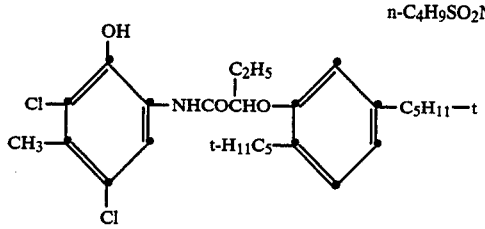

The dye-forming element was imagewise exposed as in Example 1 but with 6 milicoulombs/cm$^2$ of exposure. The exposed element was heated at 110° C. for 25 seconds to form a cyan dye image having a maximum density of 0.49 using a red filter. The cyan dye image has a minimum density of 0.14.

EXAMPLE 3

A dye-forming electrically activatable recording element was prepared as described in Example 1 with the exception that the coupler was replaced by 0.262 g of the following coupler capable of forming a yellow dye:

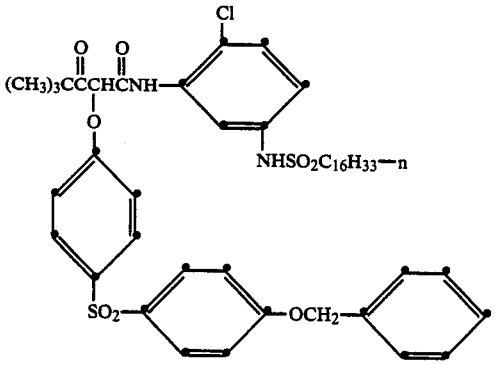

The dye-forming element was imagewise exposed as in Example 2 but with 6.0 milicoulombs/cm$^2$ of exposure. The exposed element was heated at 110° C. for 15 seconds to form a yellow dye image having a maximum density of 0.35 using a blue filter. The yellow dye image has a minimum density of 0.16.

EXAMPLES 4 TO 15

These examples illustrate use of various couplers in a dye-forming electrothermographic element and process. These also illustrate that silver trifluoroacetate, which is not present as a silver image-forming compound, can be added to such an element and process.

The procedure described in Example 3 was repeated except that 0.011 g of silver trifluoroacetate ($AgCF_3COO$) was added to the imaging composition and the coupler was replaced by one of the couplers listed in the following Table VI.

The couplers were as follows:

EXAMPLE 4

A:

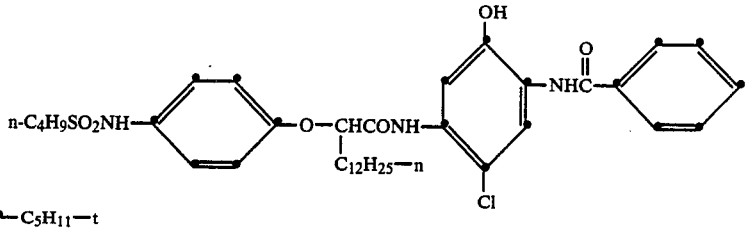

EXAMPLE 5

B:

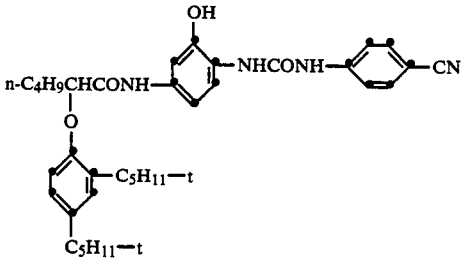

EXAMPLE 6

C:

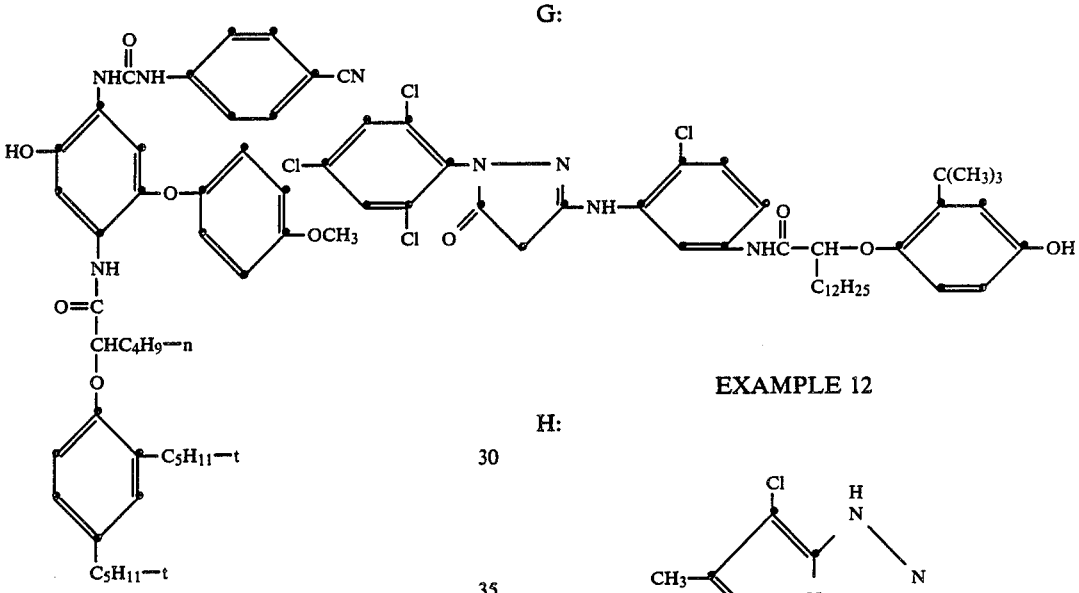
EXAMPLE 7
D:
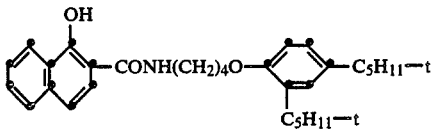
EXAMPLE 8
E:
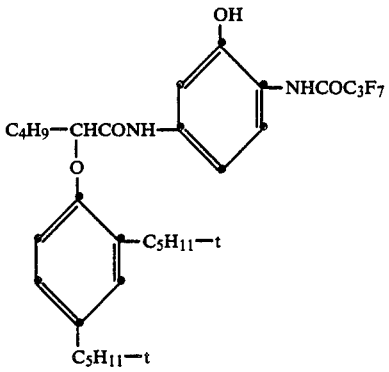
EXAMPLES 9 AND 10
F:
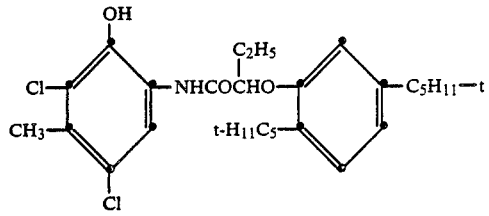
EXAMPLE 11
G:
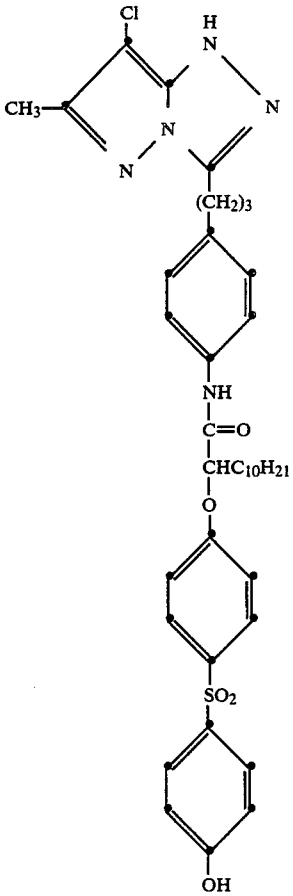
EXAMPLE 13
I:

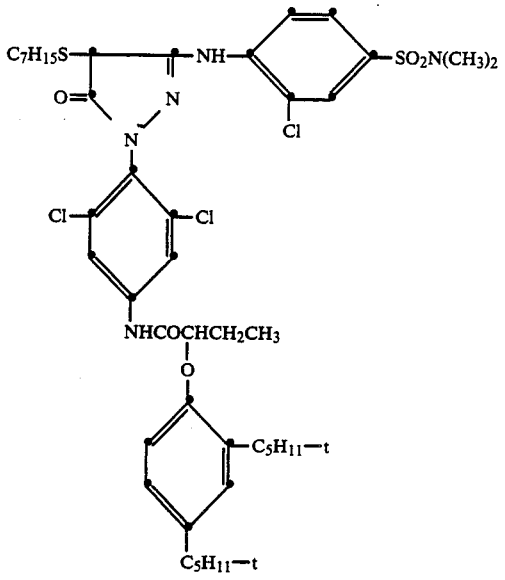

EXAMPLE 14

J:

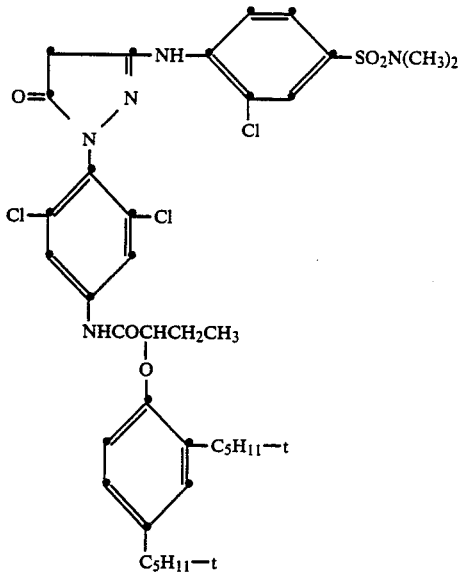

EXAMPLE 15

K:

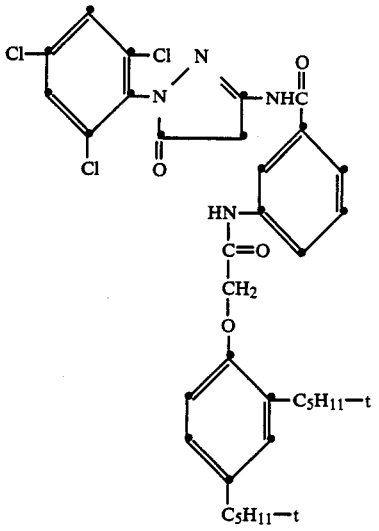

TABLE VI

| Example No. | Coupler No. | Weight (g)/melt | Color Developer | Processing temp./time °C./sec | Hue/exposure***/ Dmax Density | Dmin/ Filter |
|---|---|---|---|---|---|---|
| 4 | A | 0.224 | *$Cl_2$—BSAP | 100/90 | Cyan/14/0.68 | 0.10/Red |
| 5 | B | 0.191 | $Cl_2$—BSAP | 100/65 | Cyan/14/0.48 | 0.08/Red |
| 6 | C | 0.320 | $Cl_2$—BSAP | 90/60 | Cyan/14/0.40 | 0.10/Red |
| 7 | D | 0.152 | $Cl_2$—BSAP | 95/75 | Cyan/14/0.28 | 0.11/Red |
| 8 | E | 0.208 | $Cl_2$—BSAP | 105/45 | Cyan/14/0.54 | 0.08/Red |
| 9 | F | 0.160 | $Cl_2$—BSAP | 110/20 | Cyan/14/0.75 | 0.08/Red |
| 10 | F | 0.160 | **$Br_2$BSAP | 115/30 | Cyan/14/0.80 | 0.08/Red |
| 11 | G | 0.250 | $Br_2$BSAP | 115/60 | Magenta/2/1.02 | 0.16/Green |
| 12 | H | 0.230 | $Br_2$BSAP | 115/30 | Magenta/2/1.04 | 0.16/Green |
| 13 | I | 0.282 | $Br_2$BSAP | 115/75 | Magenta/6/1.30 | 0.14/Green |
| 14 | J | 0.125 | $Br_2$BSAP | 110/60 | Magenta/14/1.05 | 0.15/Green |

TABLE VI-continued

| Example No. | Coupler No. | Weight (g)/melt | Color Developer | Processing temp./time °C./sec | Hue/exposure***/ Dmax Density | Dmin/ Filter |
|---|---|---|---|---|---|---|
| 15 | K | 0.224 | $Br_2$BSAP | 120/90 | Magenta/0.6/0.97 | 0.13/Green |

*$Cl_2$—BSAP herein is 2,6-dichloro-4-benzenesulfonamidophenol represented by the formula:

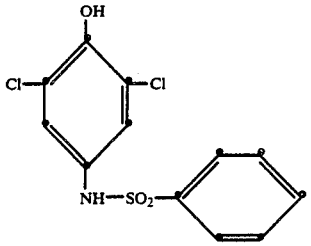

**$Br_2$—BSAP herein is 2,6-dibromo-4-benzenesulfonamidophenol represented by the formula:

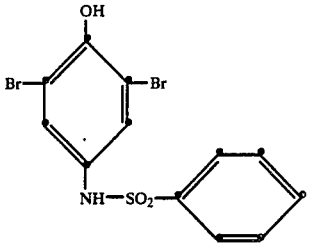

***exposure —/milicoulombs/$cm^2$

EXAMPLES 16 TO 20

These examples illustrate use of various other couplers in a dye-forming electrothermographic element and process without the presence of a silver compound. The couplers in these examples are yellow dye-forming couplers.

The procedure described in Example 3 was repeated except that the coupler was replaced by one of the couplers listed in the following Table VII. In each of these examples the color developer was 2,6-dibromo-4-benzenesulfonamidophenol and the hue of the dye formed in each case was yellow. No silver trifluoroacetate was added.

Herein the couplers used were as follows:

EXAMPLE 16

L:

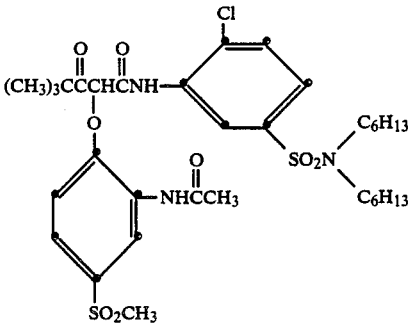

EXAMPLE 17

M:

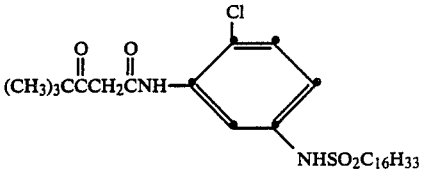

EXAMPLE 18

N:

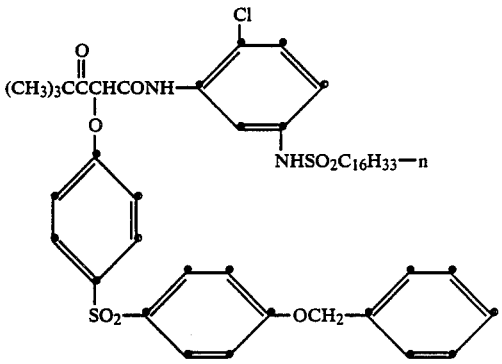

EXAMPLE 19

O:

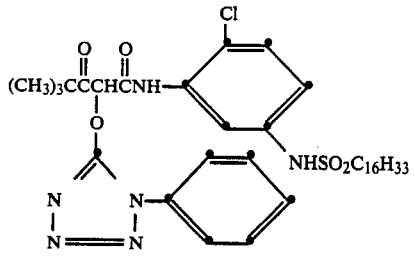

EXAMPLE 20

P:

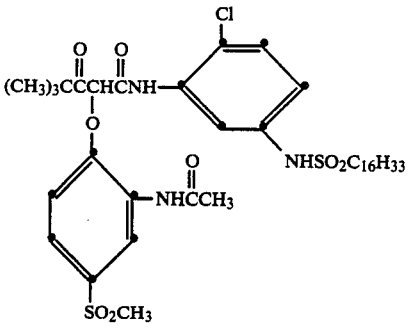

TABLE VII

| Example No. | Coupler No. | Weight g/melt | Proccessing temp./time °C./sec | Exposure*/ D max density | D min** |
|---|---|---|---|---|---|
| 16 | L | 0.232 | 110/60 | 14/0.67 | 0.20 |
| 17 | M | 0.178 | 110/60 | 6/0.53 | 0.20 |
| 18 | N | 0.143 | 105/60 | 6/0.60 | 0.16 |
| 19 | O | 0.230 | 110/60 | 6/0.50 | 0.16 |
| 20 | P | 0.250 | 105/60 | 14/0.48 | 0.14 |

*exposure - milicoulombs/cm$^2$
**read with blue filter.

EXAMPLE 21

This example illustrates use of another reducing agent in the dye-forming electrothermographic element of Example 1.

A dye-forming electrically activatable recording element was prepared as described in Example 1 except that the color developer was 2,6-dibromo-4-benzenesulfonamidophenol and 0.011 g of silver trifluoroacetate was added. The recording element was imagewise exposed at 14 milicoulombs/cm$^2$ to provide a developable image. The exposed recording element was then heated at 120° C. for 60 seconds with the image recording layer facing the heating source.

A dye negative image was formed having a green maximum transmission density of 0.52 and a minimum density of 0.12.

EXAMPLE 22

A dye-forming electrically activatable recording element was prepared as follows:

The following composition was coated at 100 micron wet coating thickness on an electrically conductive support which was a poly(ethylene terephthalate) film having a cermet layer:

| | |
|---|---|
| cellulose acetate butyrate (binder) | 10 ml of 6.25% by weight solution in acetone |
| methanol (solvent) | 1 ml |
| surfactant (SF-1066) | 0.06 g |
| tris(trimethylenediamine) cobalt(III) trifluoroacetate monohydrate (cobalt(III) Lewis base complex) | 0.50 g |
| 2,6-dichloro-3-pentadecyl-4-benzenesulfonamidophenol (reducing agent) | 0.026 g |
| 2,4-bis(trichloromethyl)-6-α-naphthyl-s-triazine (stabilizer) | 0.020 g |
| magenta dye-forming coupler which was: | 0.056 g |

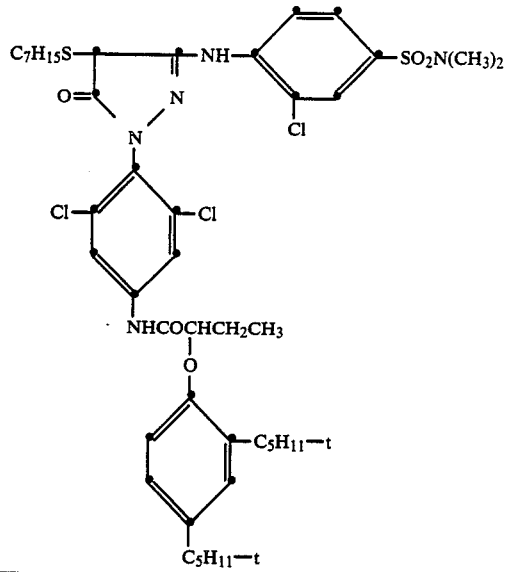

The resulting dye-forming electrothermographic element was electrically exposed by means of a mercury contact electrode at positive 100 volts varying the charge exposure from 2.0 to 0.1 milicoulombs/cm$^2$. The exposed dye-forming electrothermographic element was then heated for 10 seconds at 130° C. A dye image was formed having a green maximum transmission density of 1.85 for a charge exposure of 0.2 milicoulomb/cm$^2$. The dye image had a minimum density of 0.14.

EXAMPLE 23

The procedure described in Example 22 was repeated with the exception that the 0.026 g of 2,6-dichloro-3-pentadecyl-4-benzenesulfonamidophenol was replaced by 0.040 g of 2,6-dichloro-3-methyl-4-benzenesulfonamidophenol. The resulting dye-forming electrically activatable recording element was heated for 10 seconds at 130° C. A dye image was formed having a green maximum transmission density of 1.67 for a charge exposure of 0.14 milicoulombs. The dye image had a minimum density of 0.14.

EXAMPLE 24

This illustrates another dye-forming electrothermographic element capable of forming a magenta dye image.

A dye-forming electrothermographic element was prepared as follows:

The following composition was mixed and coated at a 100 micron wet coating thickness on an electrically conductive support consisiting of a poly(ethylene terephthalate) film coated with a subbing layer of poly(methyl methacrylate-co-vinylidene chloride) and a cermet layer:

| | |
|---|---|
| cellulose acetate butyrate (binder) (5% by weight in acetone) | 10 ml |
| methanol (solvent) | 1 ml |
| surfactant (SF-1066, which is a siloxane and a tradename of General Electric Co., U.S.A.) | 0.06 g |
| tris(trimethylenediamine) cobalt(III) trifluoromethanesulfonate (cobalt(III) Lewis base complex) | 0.550 g |
| coupler: | 0.056 g |

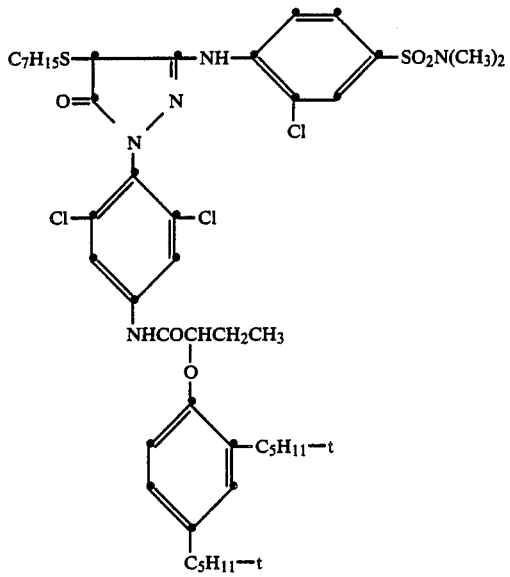

| | |
|---|---|
| 2-chloro-6-iodo-3-pentadecyl-p-aminophenol (reducing agent) | 0.057 g |
| p-toluenesulfonic acid (acid stabilizer) | 0.014 g |

The resulting dye-forming electrothermographic element was electrically imagewise exposed by a direct contact mercury electrode at positive 20 V varying the charge exposure from 0.2 to 0.007 milicoulombs/cm$^2$. The exposed element was then heated at 125° C. for six seconds. A dye image was formed having a maximum green transmission density of 1.62 and a minimum density of 0.14. The dye image had a transmission density of 1.00 at an electrical exposure of 0.04 milicoulombs/cm$^2$.

EXAMPLE 25

This illustrates a dye-forming electrothermographic element capable of forming a cyan dye image.

A dye-forming electrothermographic element was prepared as follows:

The following composition was mixed and coated at a 100 micron wet coating thickness on an electrically conductive support consisting of a poly(ethylene terephthalate) film coated with a subbing layer of poly(methyl methacrylate-co-vinylidene chloride) and a cermet layer:

| | |
|---|---|
| cellulose acetate butyrate (binder) (5% by weight in acetone) | 10 ml |
| methanol (solvent) | 1.0 ml |
| surfactant (SF-1066, which is a siloxane and a tradename of General Electric Co., U.S.A.) | 0.06 g |
| tris(trimethylenediamine) cobalt(III) trifluoromethanesulfonate (cobalt(III) Lewis base complex) | 0.550 g |
| coupler: | 0.174 g (0.27 mmole) |

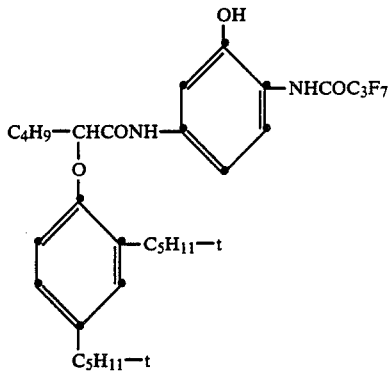

| | |
|---|---|
| developing agent: 2-chloro-6-iodo-3-pentadecyl-p-aminophenol | 0.088 g (0.18 mmole) |
| p-toluenesulfonic acid | 0.036 g |

The resulting dye-forming electrothermographic element was imagewise electrically exposed at positive 90 V varying the charge exposure from 0.2 to 0.007 milicoulombs/cm$^2$. The exposed element was then heated at 130° C. for five seconds. A cyan dye image was formed having a maximum transmission density of 1.56 and a minimum transmission density of 0.10. The dye image had a 1.00 red transmission density at a charge exposure of 0.02 milicoulombs/cm$^2$.

EXAMPLES 26 TO 32

The procedure described in Example 25 was repeated except that the developing agent and the coupler were replaced by the developing agent and the couplers listed in the following examples and Table VIII at the concentrations and with the processing times and temperatures also as listed. The coupler and developing agent in each of the examples were as follows:

EXAMPLE 26 coupler:

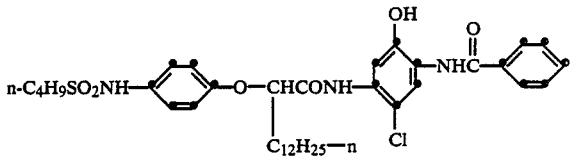

| | |
|---|---|
| developing agent: 2-chloro-6-iodo-3-pentadecyl-p-aminophenol | 0.088 g (0.18 mmole) |

EXAMPLE 27 coupler:

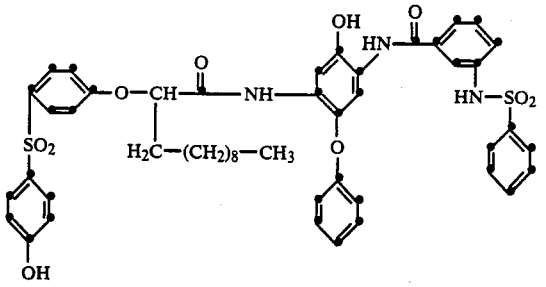

developing agent:
2-chloro-6-iodo-3-pentadecyl-p-aminophenol — 0.088 g (0.18 mmole)

EXAMPLE 28 coupler:

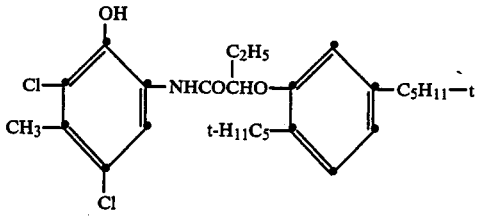

developing agent:
2-chloro-6-iodo-3-pentadecyl-p-aminophenol — 0.088 g (0.18 mmole)

EXAMPLE 29 coupler:

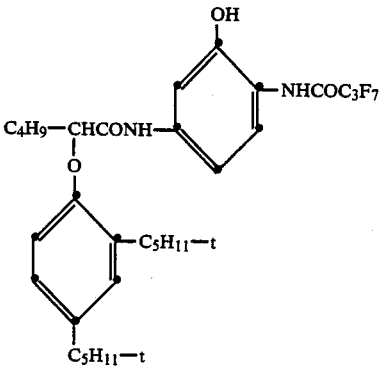

developing agent:
2,6-dibromo-3-pentadecyl-p-aminophenol

EXAMPLE 30 coupler:
(Same as Example 25)
developing agent:
2-chloro-6-bromo-3-pentadecyl-p-aminophenol

EXAMPLE 31 coupler:
(Same as Example 25)
developing agent:
2,6-dichloro-p-aminophenol

TABLE VIII

| Example No. | Concentration of Coupler: g/g of Melt | Concentration of Developing Agent g/g of Melt | Processing Time/Temp. (°C./sec) | Charge Exposure for Density of 1.0 (mcoul/cm$^2$) | Dmax (to red light) | Dmin (to red light) |
|---|---|---|---|---|---|---|
| 25 | 0.148 | 0.088 | 130/7 | 0.020 | 1.24 | 0.10 |
| 26 | 0.190 | 0.088 | 120/5 | 0.006 | 1.32 | 0.10 |
| 27 | 0.106 | 0.088 | 130/7 | 0.060 | 1.62 | 0.10 |
| 28 | 0.174 | 0.086 | 130/10 | <0.020 | 1.63 | 0.09 |
| 29 | 0.174 | 0.078 | 130/18 | 0.400 | 1.37 | 0.09 |
| 30 | 0.174 | 0.032 | 130/5 | <0.020 | 1.64 | 0.09 |
| 31 | 0.174 | 0.050 | 110/10 | 0.020 | 1.30 | 0.09 |

EXAMPLES 32 TO 45

In each of these examples a dye-forming electrothermographic element was prepared as follows:

The following composition was mixed and coated at a 100 micron thick wet coating thickness at 32° C. on an electrically conductive support consisting of a poly(ethylene terephthalate) film coated with a cermet layer and a subbing layer of poly(methyl methacrylate-co-vinylidene chloride):

| | |
|---|---|
| $Co[NH_2(CH_2)_3NH_2]_3X_3$ (see following list) | 0.80 mmole |
| Developing Agent (see following Table IX) | 0.10 mmole |
| p-toluenesulfonic acid (acid stabilizer) | 0.10 mmole |
| coupler (see following list) | 0.15 mmole |
| cellulose acetate butyrate (binder) | 0.50 g |
| surfactant (SF 1066) | 0.04 g |
| acetone (solvent) | 9.0 ml |
| methanol (solvent) | 1.0 ml |

The developing agent was dissolved in the composition as a final step before coating. In each example the resulting dye-forming electrothermographic element was electrically imagewise exposed by a direct contact mercury electrode at +80 V with a 0.001 to 2.0 milicoulomb/cm$^2$ exposure. The following couplers and developing agents were used:

EXAMPLE 32 coupler:

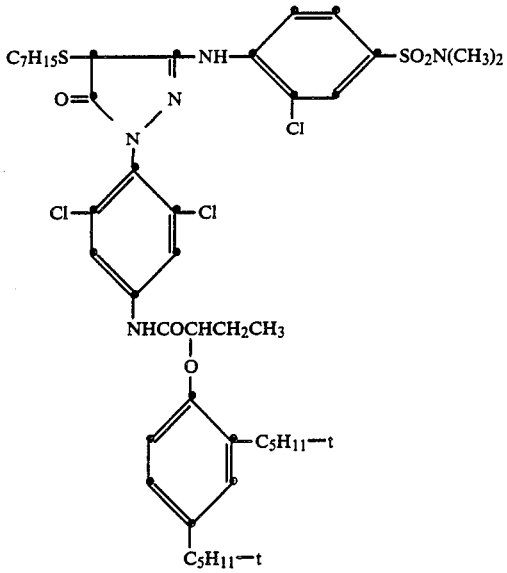

developing agent:
2,6-dichloro-3-methyl-4-aminophenol
cobalt complex:
$Co[NH_2(CH_2)_3NH_2]_3(CF_3CO_2^{\theta})_3$

EXAMPLE 33 coupler:

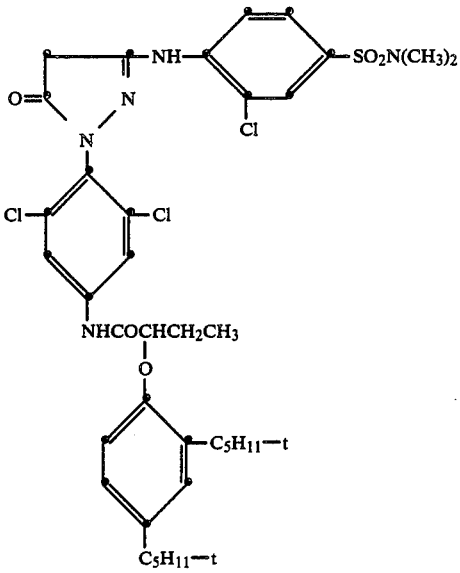

developing agent:
(Same as Example 32)
cobalt complex:
(Same as Example 32)

EXAMPLE 34 coupler:
(Same as Example 32)
developing agent:
(Same as Example 32)
cobalt complex:
(Same as Example 32)

EXAMPLE 35 coupler:
(Same as Example 32)
developing agent:
(Same as Example 32)
cobalt complex:
$Co[NH_2(CH_2)_3NH_2]_3(BF_4^{\theta})_3$

EXAMPLE 36 coupler:
(Same as Example 32)
developing agent:
(Same as Example 32)
cobalt complex:
$Co[NH_2(CH_2)_3NH_2]_3(CF_3SO_3^{\theta})_3$

EXAMPLE 37 coupler:
(Same as Example 32)
developing agent:
(Same as Example 32)
cobalt complex:
$Co[NH_2(CH_2)_3NH_2]_3(C_3F_7CO_2^{\theta})_3$

EXAMPLE 38 coupler:
(Same as Example 32)
developing agent:
(Same as Example 32)
cobalt complex:
(Same as Example 36)

EXAMPLE 39 coupler:
(Same as Example 34)
developing agent:
(Same as Example 32)
cobalt complex:
(Same as Example 36)

EXAMPLE 40 coupler:

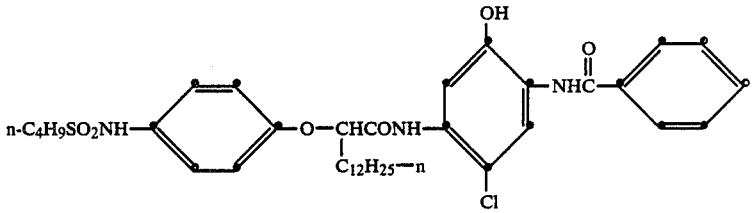

developing agent:
(Same as Example 32)
cobalt complex:
(Same as Example 36)

EXAMPLE 41 coupler:

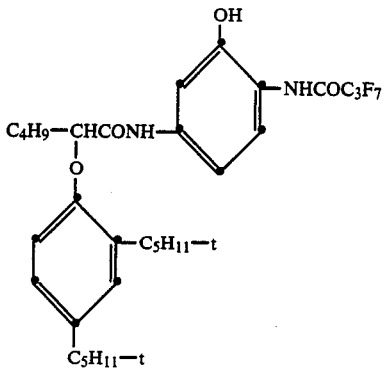

developing agent:
(Same as Example 32)
cobalt complex:
(Same as Example 36)

EXAMPLE 42 coupler:
(Same as Example 32)
developing agent:
2,6-dibromo-3-methyl-4-aminophenol
cobalt complex:
(Same as Example 36)

EXAMPLE 43 coupler:
(Same as Example 33)
developing agent:
(Same as Example 42)
cobalt complex:
(Same as Example 36)

EXAMPLE 44 coupler:
(Same as Example 40)
developing agent:
(Same as Example 42)
cobalt complex:
(Same as Example 36)

EXAMPLE 45 coupler:
(Same as Example 41)
developing agent:
(Same as Example 42)
cobalt complex:
(Same as Example 36)

TABLE IX

| Example | Voltage | Charge (mc/cm$^2$) | Thermal Process (°C./sec) | Filter | Dye Image Density | Image Dye Color |
|---|---|---|---|---|---|---|
| 32 | | | | | | |
| a | +100 v | 2.000 | 115°/6" | G | 1.96 | Magenta |
| b | +100 v | 0.200 | 115°/6" | G | 1.49 | Magenta |
| c (comparison) | — | — | 115°/6" | G | 1.19 | — |
| 33 | | | | | | |
| a | +80 v | 2.0 | 100°/8" | G | 1.84 | Magenta |
| b | +80 v | 0.1 | 100°/9" | G | 1.80 | Magenta |
| c (comparison) | +80 v | 0.020 | 100°/9" | G | 0.50 | Magenta |
| d (comparison) | — | — | 100°/9" | G | 0.16 | no image |
| 34 | | | | | | |
| a | +80 v | 0.6 | 100°/10" | G | 0.78 | Magenta |
| b | +80 v | 0.060 | 100°/10" | G | 0.73 | Magenta |
| c (comparison) | — | — | 100°/10" | G | 0.53 | no image |
| 35 | | | | | | |
| a | +80 v | 0.060–0.600 | 100°/10" | G | 1.37 | Magenta fog |
| b (comparison) | — | — | 100°/10" | G | 1.37 | no image |
| 36 | | | | | | |
| a | +80 v | 0.020 | 125°/10" | G | 1.82 | Magenta |
| b | +80 v | 0.006 | 125°/10" | G | 1.47 | Magenta |
| c | +80 v | 0.002 | 125°/10" | G | 1.28 | Magenta |
| d (comparison) | — | — | 125°/10" | G | 0.18 | no image |
| 37** | | | | | | |
| a (comparison) | +80 v | 0.200 | 125°/10" | G | 0.88 | Magenta fog, |
| b (comparison) | — | — | 125°/10" | G | 0.88 | no image |
| 38 | | | | | | |
| a | +80 v | 0.060 | 125°/10" | G | 1.85 | Magenta |
| b | +80 v | 0.001 | 125°/10" | G | 1.59 | Magenta |
| c (comparison) | — | — | 125°/10" | G | 0.16 | no image |
| 39 | | | | | | |
| a | +80 v | 0.060 | 120°/7" | G | 1.85 | Magenta |
| b | +80 v | 0.020 | 120°/7" | G | 1.57 | Magenta |
| c (comparison) | — | — | 120°/7" | G | 0.16 | no image |
| 40 | | | | | | |
| a | +80 v | 0.060 | 120°/7" | R | 0.49 | Cyan |
| b | +80 v | 0.001 | 120°/7" | R | 0.41 | Cyan |
| c (comparison) | — | — | 120°/7" | R | 0.13 | no image |
| 41 | | | | | | |
| a | +80 v | 0.060 | 120°/10" | R | 0.62 | Cyan |
| b | +80 v | 0.001 | 120°/10" | R | 0.63 | Cyan |
| c (comparison) | — | — | 120°/10" | R | 0.12 | no image |
| 42 | | | | | | |

TABLE IX-continued

| Example | Voltage | Charge (mc/cm²) | Thermal Process (°C./sec) | Filter | Dye Image Density | Image Dye Color |
|---|---|---|---|---|---|---|
| a | +80 v | 0.060 | 120°/10" | G | 1.75 | Magenta |
| b | +80 v | 0.001 | 120°/10" | G | 1.43 | Magenta |
| c (comparison) | — | — | 120°/10" | G | 0.16 | no image |
| 43 | | | | | | |
| a | +80 v | 0.060 | 120°/5" | G | 1.98 | Magenta |
| b | +80 v | 0.001 | 120°/5" | G | 1.91 | Magenta |
| c (comparison) | — | — | 120°/5" | G | 0.16 | no image |
| 44 | | | | | | |
| a | +80 v | 0.060 | 115°/7" | R | 0.58 | Cyan |
| b | +80 v | 0.005 | 115°/7" | R | 0.55 | Cyan |
| c (comparison) | — | — | 115°/7" | R | 0.13 | no image |
| 45 | | | | | | |
| a | +80 v | 0.060 | 115°/5" | R | 0.70 | Cyan |
| b | +80 v | 0.001 | 115°/5" | R | 0.64 | Cyan |
| c (comparison) | — | — | 115°/5" | R | 0.13 | no image |

*Cerment coated support has minimum density of 0.12 to red light and minimum density of 0.16 to green light.
**Examples 35 and 37 were not optimized to the combination of components to provide a useful image.

EXAMPLE 46

This illustrates formation of a yellow dye image in a dye-forming electrothermographic element.

A dye-forming electrothermographic element was prepared as follows:

The following composition was mixed and coated with a 50 micron wet coating thickness on an electrically conductive support consisting of poly(ethylene terephthalate) film support having thereon a layer of cermet and a subbing layer of poly(methyl methacrylate-co-vinylidene chloride):

| | |
|---|---|
| cellulose acetate butyrate (binder) (5% by weight in acetone solution) | 7.5 ml |
| methanol | 2.5 ml |
| surfactant (SF-1066) | 0.06 g |
| tris(trimethylenediamine) cobalt(III) trifluoromethane-sulfonate | 0.196 g |
| 3-methyl-1-phenyl-2-pyrazoline-5-one (coupler) | 0.018 g |
| 3-ethyl-2-benzothiazolinone benzene sulfonylhydrazone (developing agent) | 0.024 g |
| surfactant (Pluronic F-98, surfactant which is a trademark of BASF Co., U.S.A. and is an ethylene oxide-propylene glycol compound) | 0.080 g |
| lithium trifluoroacetate | 0.040 g |
| ethylene glycol | 0.025 g |
| p-toluenesulfonic acid | 0.004 g |

The resulting dye-forming electrothermographic element was electrically imagewise exposed by direct contact with a mercury electrode at positive 50 V varying the charge exposure. The exposed element was then heated at 125° C. for three seconds. With an exposure of $2\times10^{-5}$ coulombs/cm² a yellow dye image was formed having a maximum density of 1.33 and a minimum density of 0.13.

EXAMPLE 47

This example illustrates an especially useful polymeric binder in a dye-forming electrothermographic element.

A cyan dye-forming electrothermographic element was prepared as follows:

The following composition was mixed and coated at a 100 microns wet coating thickness on an electrically conductive support which was a poly(ethylene terephthalate) film having a coating of cermet and a subbing coating of poly(methyl acrylate-co-vinylidene chloride) (80:20 mole percent ratio):

| | |
|---|---|
| poly(vinyl acetate-co-1-vinyl-2-pyrrolidone) (70:30 mole percent) (5% by weight in 8:2 acetone: methanol) (binder) | 10 ml |
| tris(trimethylenediamine) cobalt(III) trifluoro-methanesulfonate | 0.554 g |
| coupler: | 0.174 g |

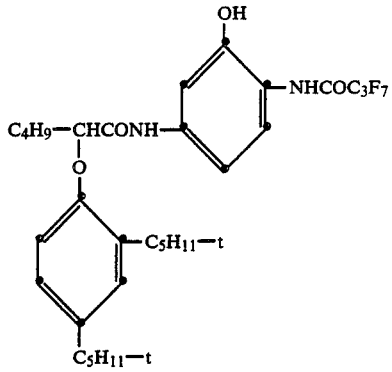

| | |
|---|---|
| developing agent: | 0.088 g |
| 2-chloro-6-iodo-3-pentadecyl-p-aminophenol p-toluenesulfonic acid | 0.036 g |
| surfactant: (SF 1066) | 0.06 g |

The resulting dye-forming electrothermographic element was imagewise exposed by direct electrical contact using a mercury contact electrode at positive 20 V varying the charge exposure from 0.2 to 0.007 milicoulombs/cm². The exposed element was then heated at 130° C. for ten seconds to form a cyan dye image having a maximum transmission density of 1.94 and a minimum transmission density of 0.14.

EXAMPLE 48

This illustrates that an image recording element according to the invention can compromise dyes that change color or become colorless in response to imagewise electrical exposure followed by thermal processing.

An electrically activatable recording element was prepared by coating the following composition at a 100 micron wet coating thickness on an electrically conductive film support consisting of a poly(ethylene terephthalate) film support containing a cermet coating:

| | |
|---|---|
| 2,4-diphenyl-6-(β-methyl-3,4-di-ethoxystyryl) pyrrylium tetrafluoroborate | 0.20 mmole |
| $Co\{NH_2(CH_2)_3NH_2\}_3(CF_3CO_2).H_2O$ | 0.40 mmole |
| 2-phenylsulfonyl-1,4-hydroquinone | 0.40 mmole |
| cellulose acetate butyrate (binder) | 1.00 g |
| ethylene chloride (solvent) | 9.83 g |
| methanol (solvent) | 1.74 g |

The resulting electrothermographic element was imagewise exposed by contacting the element with a mercury contact electrode and passing a 200 volt potential between the contact electrode and the electrically conductive support. Current flow was monitored and stopped at various exposures. The exposed films were thermally processed on a heated metal block at 130° C. for 30 seconds. The red pyrrylium dye was bleached in the electrically exposed areas as indicated in the following table:

| Current | Processed Green Density | |
|---|---|---|
| (coulomb/cm2) | +Hg electrode | −Hg electrode |
| 2000 | 0.46 | 0.47 |
| 600 | 0.51 | 0.47 |
| 200 | 0.62 | 0.48 |
| 60 | 0.56 | 1.11 |
| 40 | 0.84 | — |
| 30 | 1.31 | — |
| 0 (Control) | 1.54 | 1.54 |

EXAMPLE 49

This illustrates a dye-forming electrothermographic element comprising a leuco dye which forms a dye image upon processing.

A dye-forming electrothermographic element was prepared as follows:

| | |
|---|---|
| (a) | image recording layer |
| (b) | poly(methylacrylate-co-vinylidene chloride) (weight ratio 20/80) subbing layer |
| (c) | electrically conductive layer |
| (d) | support |

The image recording layer (a) was coated at a 100 micron wet coating thickness on a subbing layer over layer (b) which was a cermet layer on a poly(ethylene terephthalate) film support (c). The coating composition for layer (a) consisted of:

| | |
|---|---|
| cellulose acetate butyrate (binder) (6.25% by weight solution in acetone) | 10 ml |
| methanol (solvent) | 0.5 ml |
| surfactant (SF-1066) | 0.06 g |
| 2,5-dihydroxy-4-methylacetophenone (reducing agent) | 0.066 g |
| tris(trimethylenediamine) cobalt(III) trifluoroacetate monohydrate | 0.51 g |
| Leuco dye which was 2-(p-iodophenyl-3-(p-nitrophenyl)-5-phenyl-2H—tetrazolium tetrafluoroborate | 0.115 g |

The resulting dye-forming electrothemographic element was imagewise exposed by means of a photoconductor as illustrated in FIG. 4 of the drawings. The exposure was with a tungsten light source through a silver test target. The photoconductor consisted of a 12 micron thick aggregate-type photoconductor as described in U.S. Pat. No. 3,615,414 coated on an electrically conductive support. The exposure was for 4 seconds and was sufficient to form a developable image in the image recording layer (a). A voltage of 2000 V with a positive polarity was applied to the photoconductor during imagewise exposure.

After exposure, the sandwich was separated and the exposed dye-forming electrothermographic element was heated at 100° C. for 10 seconds with the side of the element containing the image recording layer facing the heating means which was a heated platten. This produced a good quality magenta dye negative image having a maximum density to blue light of 2.63 with a minimum density of 0.15.

The image recording layer can comprise more than one dye-forming layer. A barrier layer can be present between each dye-forming layer.

EXAMPLE 50

The procedure described in Example 50 was repeated except that the leuco dye was replaced with the dye-forming compound (2,5-diphenyl-3-(1-naphthyl)-2H-tetrazolium chloride. A magenta dye image was formed upon heating the dye-forming electrothermographic element for 7 seconds at 125° C. The dye image had a maximum density of 2.08 and minimum density of 0.25 using a blue filter.

EXAMPLE 51

The procedure described in Example 50 was repeated except that the leuco dye was replaced with the dye-forming compound Nitro blue tetrazolium chloride represented by the formula:

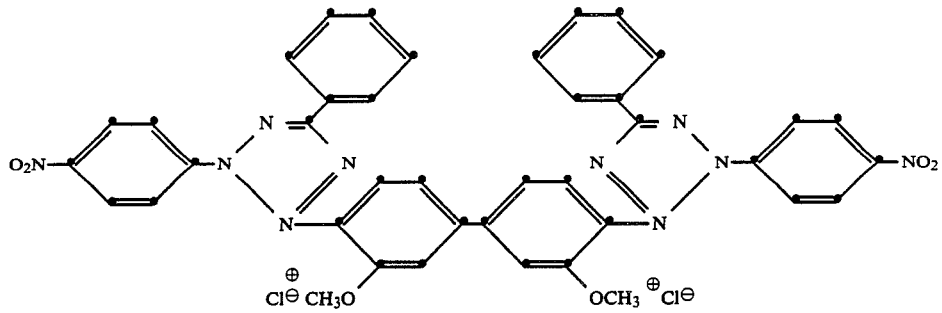

A neutral (black) dye image was formed upon heating the exposed dye-forming electrothermographic element for 15 seconds at 140° C. The dye image had a maximum density of 2.24 with a minimum density of 0.15.

EXAMPLE 52

The procedure described in Example 50 was repeated except that the leuco dye was replaced with the dye-forming compound Tetranitro blue tetrazolium chloride represented by the formula:

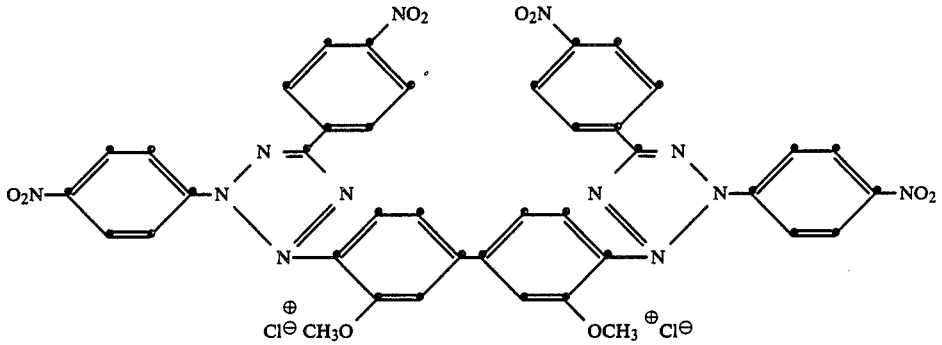

A neutral (black) dye image was formed upon heating the exposed dye-forming electrothermographic element for 7 seconds at 100° C. The dye image had a maximum density of 0.75 and a minimum density of 0.22 using a blue filter.

EXAMPLE 53

The procedure described in Example 50 was repeated except that the leuco dye was replaced with the dye-forming compound 2,3-diphenyl-5-methyl-2H-tetrazolium bromide represented by the formula:

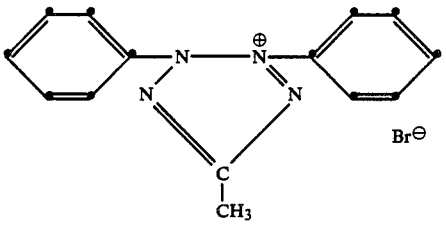

A yellow dye image was formed upon heating the exposed dye-forming electrothermographic element for 12 seconds at 120° C. The dye image had a maximum density of 1.63 and a minimum density of 0.18 using a blue filter.

The invention has been described in detail with particular reference to preferred embodiments thereof, but it will be understood that variations and modifications can be effected within the spirit and scope of the invention.

What is claimed is:

1. In a dye-forming electrothermographic element comprising an electrically conductive support bearing an electrically activatable recording layer, the improvement wherein said electrically activatable recording layer comprises:

(a) a reducing agent or reducing agent precursor capable of being activated by a Lewis base;

(b) a cobalt(III) Lewis base complex; and (c) at least one of (i) a reducible dye-forming compound that has an oxidation state above that of the conjugate dye, (ii) a dye capable of changing its wavelength of absorption by reaction with a Lewis base, and (iii) a dye-forming coupler.

2. A dye-forming electrothermographic element as in claim 1 wherein the reducible dye-forming compound is a reducible leuco dye.

3. A dye-forming electrothermographic element as in claim 1 wherein said electrically activatable recording layer comprises a polymeric binder.

4. A dye-forming electrothermographic element as in claim 1 wherein said reducing agent precursor in (a) is a quinone reducing agent precursor that is capable of being activated by an amine.

5. A dye-forming electrothermographic element as in claim 1 wherein said cobalt(III) Lewis base complex in (b) is a cobalt(III) hexammine complex or a cobalt(III) tris(trimethylenediamine) complex.

6. A dye-forming electrothermographic element as in claim 1 wherein said reducible dye-forming compound in (c) (i) is a tetrazolium or triazolium salt.

7. A dye-forming electrothermographic element as in claim 1 wherein said reducible dye-forming compound in (c) (i) is a compound selected from the group consisting of:

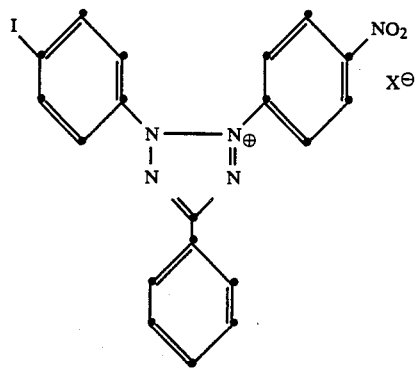

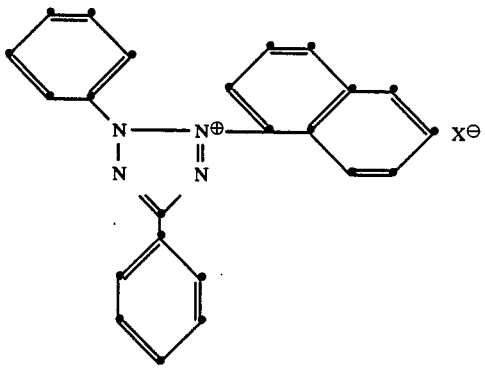

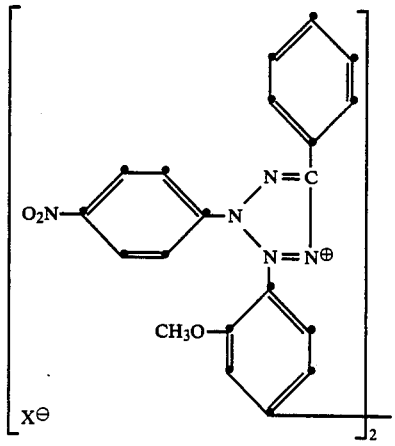

-continued

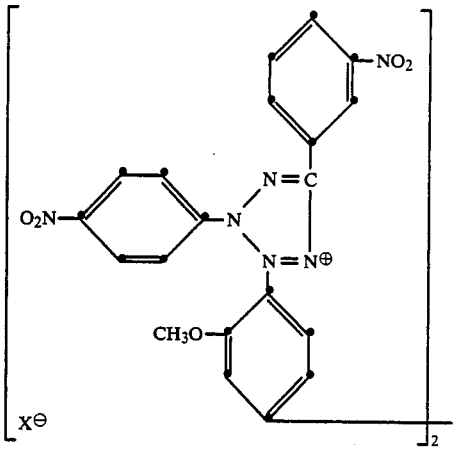

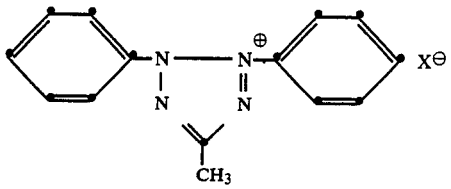

and combinations thereof wherein X is an anion.

8. A dye-forming electrothermographic element as in claim 1 wherein said electrically activatable recording layer comprises in a binder:

(a) a reducing agent precursor consisting essentially of 2,5-dihydroxy-4-methylacetophenone;

(b) a cobalt(III) Lewis base complex consisting essentially of tris(trimethylenediamine) cobalt(III) trifluoroacetate monohydrate; and (c) a reducible dye-forming compound which is a tetrazolium salt consisting essentially of 2-(p-iodophenyl-3-p-nitrophenyl)-5-phenyl-2H-tetrazolium tetrafluoroborate.

9. In a dye-forming electrothermographic element comprising an electrically conductive support bearing an electrically activatable recording layer, the improvement wherein said electrically activatable recording layer comprises, (a) a reducing agent or reducing agent precursor capable of being activated by a Lewis base;

(b) a cobalt(III) Lewis base complex; and (c) a reducible decolorizable dye that is capable of being decolorized in the reduced state.

10. A dye-forming electrothermographic element comprising an electrically conductive support bearing an electrically activatable recording layer, the improvement wherein said electrically activatable recording layer comprises:

(a) a reducing agent or reducing agent precursor capable of being activated by a Lewis base;

(b) a cobalt(III) Lewis base complex; and, (c) a dye-forming coupler capable of reacting with the oxidized form of the reducing agent to form a dye.

11. A dye-forming electrothermographic element as in claim 10 wherein said electrically activatable recording layer comprises (d) a polymeric binder.

12. A dye-forming electrothermographic element as in claim 10 wherein said electrically activatable recording layer comprises a dye-forming coupler capable of forming a yellow, magenta or cyan dye.

13. A dye-forming electrothermographic element as in claim 10 wherein said cobalt(III) Lewis base complex is a cobalt(III) hexammine complex or a cobalt(III) tris(trimethylenediamine) complex.

14. A dye-forming electrothermographic element as in claim 10 wherein said electrically activatable recording layer comprises:

(a) a sulfonamidophenol reducing agent;

(b) a cobalt(III) Lewis base complex; and (c) a dye-forming coupler comprising:

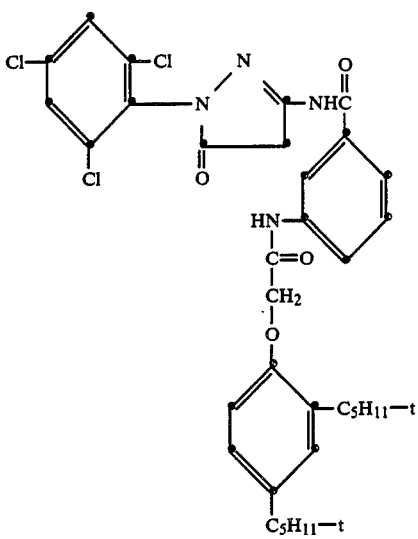

(i)

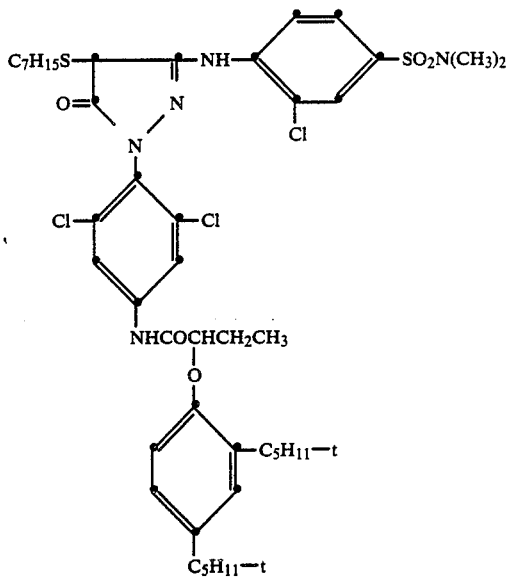

(ii)

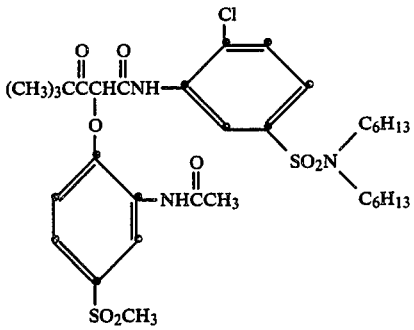

(iii)

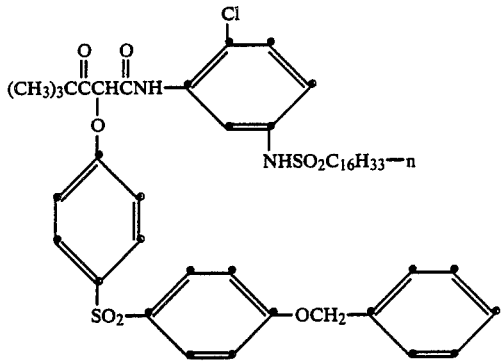

(iv)

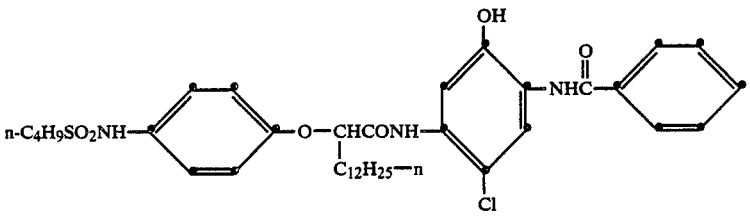

(v)

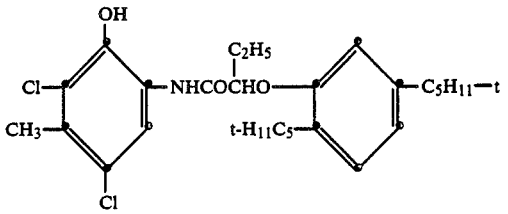

(vi)

or combinations thereof.

15. In a dye-forming electrothermographic element comprising an electrically conductive support bearing an electrically activatable recording layer, the improvement wherein said electrically activatable recording layer comprises:

(a) a 2,6-dibromo or 2,6-dichloro-4-benzenesulfonamidophenol reducing agent;

(b) tris(trimethylenediamine) cobalt(III) trifluoroacetate monohydrate;

(c) 2,4-bis(trichloromethyl)-6-a-naphthyl-s-triazine; and (d) a dye-forming coupler represented by the formula:

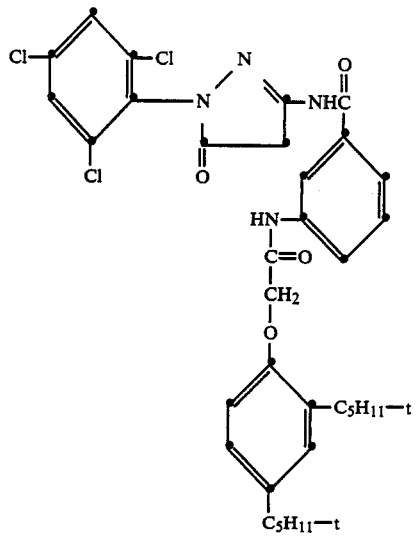

16. A dye-forming, electrically activatable recording process for producing a dye image in an electrically activatable recording element comprising an electrically conductive support bearing an electrically activatable recording layer comprising:

(a) a reducing agent or reducing agent precursor capable of being activated by a Lewis base;

(b) a cobalt(III) Lewis base complex; and (c) (i) a reducible dye-forming compound that has an oxidation state above that of the conjugate dye or (ii) a dye capable of changing its wavelength of absorption by reaction with a Lewis base, said process comprising the steps of:

(I) applying an electrical potential imagewise to said recording element of a magnitude and for a time sufficient to produce a charge density sufficient to produce a latent image; then (II) heating said recording element substantially uniformly at a temperature and for a time sufficient to form a dye image in the recording layer.

17. A dye-forming, electrically activatable recording process as in claim 16 comprising in step (II) heating said recording element at a temperature within the range of about 100° C. to about 180° C.

18. A dye-forming, electrically activatable recording process for producing a dye image in an electrically activatable recording element comprising an electrically conductive support bearing an electrically activatable recording layer comprising, in a polymeric binder:

(a) a reducing agent precursor which is a quinone reducing agent precursor that is capable of being activated by an amine;

(b) a cobalt(III) Lewis base complex which is a cobalt(III) hexammine complex or a cobalt(III) tris(trimethylenediamine) complex; and (c) a reducible dye-forming compound which is a tetrazolium or triazolium salt;

said process comprising the steps of:

(I) applying an electrical potential imagewise to said recording element of a magnitude and for a time sufficient to produce a charge density sufficient to produce a latent image; then (II) heating said recording element substantially uniformly at a temperature within the range of about 100° C. to about 180° C. and for a time sufficient to form a dye image in the recording layer.

19. A dye-forming, electrically activatable recording process for producing a dye image in an electrically activatable recording element comprising, in sequence:

(a) an electrically conductive layer, (b) a photoconductor layer, (c) an electrically activatable recording layer separated from (b) by an air gap of up to 20 microns or an electrically conductive interlayer, and comprising, in an electrically conductive binder, in reactive association, (A) a reducing agent precursor;

(B) a cobalt(III) Lewis base complex; and (C) (i) a reducible dye-forming compound that has an oxidation state above that of the conjugate dye or (ii) a dye capable of changing its wavelength of absorption by reaction with a Lewis base; and (d) an electrically conductive support; said process comprising the steps of:

(I) imagewise altering the conductivity of said photoconductive layer, in accord with an image to be recorded;

(II) applying an electrical potential across said photoconductive layer and said recording layer of a magnitude and for a time sufficient to produce a latent image in said recording layer corresponding to the image to be recorded; then (III) heating said recording layer substantially uniformly at a temperature and for a time sufficient to form a dye image in said recording layer.

20. A process as in claim 19 wherein said recording layer is heated in (III) to a temperature within the range of about 100° C. to about 180° C. until a dye image is formed in said recording layer.

* * * * *

UNITED STATES PATENT AND TRADEMARK OFFICE

CERTIFICATE OF CORRECTION

PATENT NO. : 4,752,547

DATED : June 21, 1988

INVENTOR(S) : Stanley W. Cowan, James C. Fleming and Mark Lelental

It is certified that error appears in the above-identified patent and that said Letters Patent are hereby corrected as shown below:

Title page, line 2, "Cowen" should read -- Cowan --.

Title page, [75], "Cowen" should read -- Cowan --.

Column 54, lines 2 - 19, the structure should read

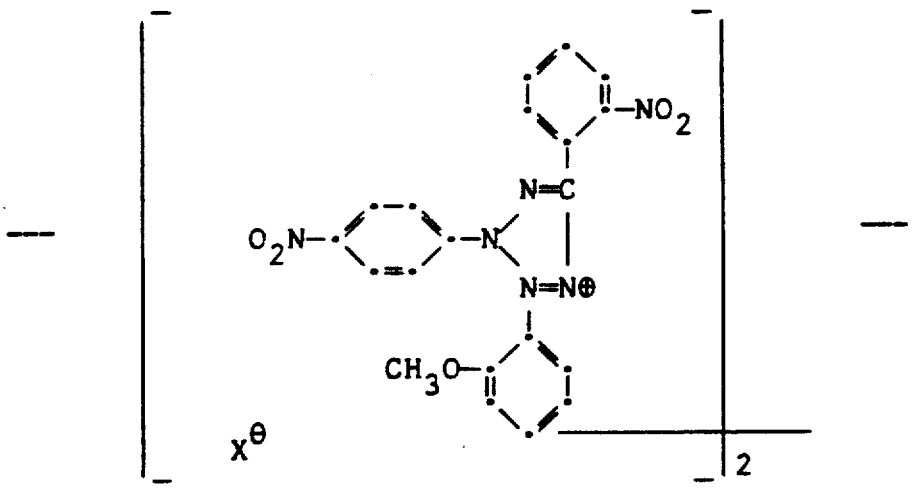

Signed and Sealed this

Thirty-first Day of January, 1989

*Attest:*

DONALD J. QUIGG

*Attesting Officer*

*Commissioner of Patents and Trademarks*